US010233918B2

(12) United States Patent
Tanaka

(10) Patent No.: US 10,233,918 B2
(45) Date of Patent: Mar. 19, 2019

(54) BLOWER

(71) Applicant: Murata Manufacturing Co., Ltd., Kyoto (JP)

(72) Inventor: Nobuhira Tanaka, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 0 days.

(21) Appl. No.: 15/959,734

(22) Filed: Apr. 23, 2018

(65) Prior Publication Data

US 2018/0306178 A1 Oct. 25, 2018

Related U.S. Application Data

(63) Continuation of application No. 15/231,831, filed on Aug. 9, 2016, now Pat. No. 9,976,547, which is a (Continued)

(30) Foreign Application Priority Data

Feb. 21, 2014 (JP) ..... 2014-031542
Apr. 28, 2014 (JP) ..... 2014-092603

(51) Int. Cl.
*F04B 43/04* (2006.01)
*F04B 45/047* (2006.01)
(Continued)

(52) U.S. Cl.
CPC ..... *F04B 45/047* (2013.01); *F04B 35/04* (2013.01); *F04B 39/121* (2013.01);
(Continued)

(58) Field of Classification Search
CPC ..... F04B 43/023; F04B 43/04; F04B 43/043; F04B 45/04; F04B 45/047
See application file for complete search history.

(56) References Cited

U.S. PATENT DOCUMENTS 6,042,345 A 3/2000 Bishop et al.
6,071,088 A 6/2000 Bishop et al.
(Continued)

FOREIGN PATENT DOCUMENTS

GB 2013-22103 1/2014
JP 2008-180161 A 8/2008
(Continued)

OTHER PUBLICATIONS

Written Opinion for PCT/JP2015/053168 dated Apr. 28, 2015.
International Search Report for PCT/JP2015/053168 dated Apr. 28, 2015.

*Primary Examiner* — Patrick Hamo
(74) *Attorney, Agent, or Firm* — Pearne & Gordon LLP

(57) ABSTRACT

A piezoelectric blower includes a valve, a housing, a vibrating plate, and a piezoelectric element. The vibrating plate forms, together with the housing, a column-shaped blower chamber such that the blower chamber is interposed therebetween in a thickness direction of the vibrating plate. The vibrating plate and the housing are formed such that the blower chamber has a radius (a). The piezoelectric element causes the vibrating plate to undergo concentric bending vibration at a resonance frequency (f). The radius (a) of the blower chamber and the resonance frequency (f) of the vibrating plate satisfy a relationship of $0.8\times(k_0c)/(2\pi) \leq af \leq 1.2\times(k_0c)/(2\pi)$, where an acoustic velocity of gas that passes through the blower chamber is (c) and a value that satisfies a relationship of a Bessel function of a first kind of $J_0(k_0)=0$ is $k_0$.

21 Claims, 20 Drawing Sheets

Related U.S. Application Data continuation of application No. PCT/JP2015/053168, filed on Feb. 5, 2015.

(51) Int. Cl.

| | |
|---|---|
| ***F04B 35/04*** | (2006.01) |
| ***F04B 39/12*** | (2006.01) |
| ***F04B 53/10*** | (2006.01) |
| ***F04D 33/00*** | (2006.01) |

(52) U.S. Cl.

CPC ..... *F04B 43/046* (2013.01); *F04B 53/10* (2013.01); *F04D 33/00* (2013.01)

(56) References Cited

U.S. PATENT DOCUMENTS

| | | | |
|---|---|---|---|
| 6,074,178 | A | 6/2000 | Bishop et al. |
| 9,445,710 | B2 | 9/2016 | Miki et al. |
| 2009/0087323 | A1 | 4/2009 | Blakey et al. |
| 2010/0310398 | A1 | 12/2010 | Rensburg et al. |
| 2011/0280755 | A1 | 11/2011 | Wackerle et al. |
| 2013/0236338 | A1 | 9/2013 | Locke et al. |
| 2015/0023821 | A1 | 1/2015 | Campbell et al. |
| 2015/0071797 | A1 | 3/2015 | Takeuchi |
| 2015/0337828 | A1 | 11/2015 | Refai-Ahmed et al. |
| 2017/0058882 | A1 | 3/2017 | Hirata et al. |
| 2017/0058884 | A1 | 3/2017 | Tanaka et al. |
| 2017/0138357 | A1 | 5/2017 | Kondo et al. |

FOREIGN PATENT DOCUMENTS

| | | | |
|---|---|---|---|
| JP | 2008-537057 | A | 9/2008 |
| JP | 4795428 | B2 | 10/2011 |
| JP | 2012-528980 | A | 11/2012 |
| JP | 2013-100746 | A | 5/2013 |
| WO | 2006/111775 | A1 | 10/2006 |
| WO | 2010/139916 | A1 | 12/2010 |
| WO | 2013/117945 | A1 | 8/2013 |
| WO | 2013187271 | A1 | 12/2013 |

BLOWER

BACKGROUND OF THE DISCLOSURE

This application is a continuation of U.S. patent application Ser. No. 15/231,831 filed Aug. 9, 2016, which is a continuation of International Application No. PCT/JP2015/053168 filed on Feb. 5, 2015 which claims priority from Japanese Patent Application No. 2014-092603 filed on Apr. 28, 2014 and Japanese Patent Application No. 2014-031542 filed on Feb. 21, 2014. The contents of these applications are incorporated herein by reference in their entireties.

FIELD OF THE DISCLOSURE

The present disclosure relates to a blower that transports gas.

DESCRIPTION OF THE RELATED ART

Hitherto, various types of blowers that transport gas have been known. For example, Patent Document 1 discloses a piezoelectric driven type pump.

The pump includes a piezoelectric disc, a disc to which the piezoelectric disc is joined, and a body that, together with the disc, forms a cavity. The body has an inlet into which a fluid flows and an outlet from which the fluid flows out. The inlet is provided between a central axis of the cavity and an outer periphery of the cavity. The outlet is provided at the central axis of the cavity.

Here, the inlet is provided at a node of pressure vibration of the cavity. Therefore, the pressure in the inlet is constant at all times. Consequently, in the pump according to Patent Document 1, even if the inlet is provided between the central axis of the cavity and the outer periphery of the cavity, it is possible to suppress a reduction in discharge pressure and discharge flow rate.

Patent Document 1: Japanese Patent No. 4795428

BRIEF SUMMARY OF THE DISCLOSURE

However, in the pump according to Patent Document 1, when the diameter of the inlet is small, a sufficient flow rate of the fluid cannot be obtained. In addition, when the diameter of the inlet is small, for example, dust may clog the inlet.

In contrast, when the diameter of the inlet is large, the inlet extends to a location that is far away from the node of the pressure vibration of the cavity, as a result of which the pressure in the inlet is not constant at all times and changes. Therefore, in the pump according to Patent Document 1, when the diameter of the inlet is large, discharge pressure and discharge flow rate are reduced.

It is an object of the present disclosure to provide a blower that can prevent a reduction in discharge pressure and discharge flow rate even if a large opening portion is provided for ensuring sufficient flow rate.

In order to solve the aforementioned problem, the blower according to the present disclosure has the following structure.

The blower according to the present disclosure includes an actuator and a housing. The actuator includes a vibrating plate and a driving member. The vibrating plate includes a first principal surface and a second principal surface. The driving member is provided on at least one of the first principal surface and the second principal surface of the vibrating plate. The driving member causes the vibrating plate to undergo concentric bending vibration.

The housing forms, together with the actuator, a first blower chamber such that the first blower chamber is interposed therebetween in a thickness direction of the vibrating plate. The housing includes a first vent hole that allows a center of the first blower chamber to communicate with an outside of the first blower chamber.

At least one of the vibrating plate and the housing includes an opening portion that allows an outer periphery of the first blower chamber to communicate with the outside of the first blower chamber.

A shortest distance a from a central axis of the first blower chamber to the outer periphery of the first blower chamber and a resonance frequency f of the vibrating plate satisfy a relationship of $0.8\times(k_0c)/(2\pi)\leq af\leq 1.2\times(k_0c)/(2\pi)$, where an acoustic velocity of gas that passes through the first blower chamber is c and a value that satisfies a relationship of a Bessel function of a first kind of $J_0(k_0)=0$ is $k_0$.

In this structure, the vibrating plate and the housing are formed such that the shortest distance of the first blower chamber is a. The driving member vibrates the vibrating plate at the resonance frequency f. The resonance frequency f of the vibrating plate is determined by, for example, the thickness of the vibrating plate and the material of the vibrating plate.

Here, when $af=(k_0c)/(2\pi)$, an outermost node among nodes of vibration of the vibrating plate coincides with a node of pressure vibration of the first blower chamber, and pressure resonance occurs. Further, even when the relationship of $0.8\times(k_0c)/(2\pi)\leq af\leq 1.2\times(k_0c)/(2\pi)$ is satisfied, the outermost node among the nodes of vibration of the vibrating plate substantially coincides with the node of pressure vibration of the first blower chamber.

Therefore, when the relationship of $0.8\times(k_0c)/(2\pi)\leq af\leq 1.2\times(k_0c)/(2\pi)$ is satisfied, the blower having this structure can realize high discharge pressure and high discharge flow rate.

In this structure, since the outer periphery of the first blower chamber becomes the node of pressure vibration of the first blower chamber, the pressure at the outer periphery of the first blower chamber is constant at all times. For example, when air is used as the gas, the pressure at the outer periphery of the first blower chamber is atmospheric pressure at all times.

Therefore, even if the outer periphery of the first blower chamber communicates with the outside of the first blower chamber through the opening portion that is larger than a first vent hole in Patent Document 1, the blower having this structure can prevent a reduction in discharge pressure and discharge flow rate.

Consequently, the blower having this structure can prevent a reduction in discharge pressure and discharge flow rate even if the large opening portion is provided for ensuring sufficient flow rate.

Thus, the blower having this structure can prevent the large opening portion from becoming clogged with, for example, dust. That is, the blower having this structure can prevent a reduction in discharge pressure and discharge flow rate caused by, for example, dust.

It is further desirable that the shortest distance a and the resonance frequency f satisfy the relationship of $0.9\times(k_0c)/(2\pi)\leq af\leq 1.1\times(k_0c)/(2\pi)$.

It is desirable that the first vent hole in the housing be provided with a first valve that prevents the gas from flowing into the first blower chamber from the outside of the first blower chamber.

The blower having this structure can prevent the gas from flowing into the first blower chamber from the outside of the first blower chamber through the first vent hole by using the valve. Therefore, the blower having this structure can realize high discharge pressure and high discharge flow rate.

It is desirable that, in a range from the central axis of the first blower chamber to the outer periphery of the first blower chamber, the number of zero crossover points of vibration displacement of the vibrating plate be equal to the number of zero crossover points of pressure change in the blower chamber. Here, each point on the vibrating plate from the central axis of the first blower chamber to the outer periphery of the first blower chamber is displaced by vibration. In addition, from the central axis of the first blower chamber to the outer periphery of the first blower chamber, the pressure at each point at the first blower chamber due to the vibrating plate being vibrated.

In this structure, when the vibrating plate vibrates, the distribution of the displacements of the respective points on the vibrating plate becomes a distribution that is close to the distribution of the pressure changes at the respective points at the first blower chamber. That is, when the vibrating plate vibrates, the points on the vibrating plate are displaced in accordance with the pressure changes at the respective points at the first blower chamber.

Therefore, the blower having this structure is capable of transmitting vibration energy of the vibrating plate to the gas in the first blower chamber almost without loss of the vibration energy of the vibrating plate. Consequently, the blower having this structure can realize high discharge pressure and high discharge flow rate.

A pressure change distribution u(r) of the points at the first blower chamber is expressed by the formula $u(r)=J_0(k_0r/a)$, where the distance from the central axis of the first blower chamber is r.

It is desirable that the vibrating plate include a vibrating portion, a frame portion, and a plurality of connecting portions. The vibrating portion forms, together with the housing, the first blower chamber such that the first blower chamber is interposed therebetween in the thickness direction of the vibrating plate. The frame portion surrounds the vibrating portion and is joined to the housing. The connecting portions connect the vibrating portion and the frame portion to each other and elastically support the vibrating portion with respect to the frame portion.

In this structure, the vibrating portion is flexibly elastically supported with respect to the frame portion by the plurality of connecting portions, so that the bending vibration of the vibrating portion is hardly prevented. Therefore, in the blower according to the present disclosure, loss resulting from the bending vibration of the vibrating portion is reduced.

It is desirable that the opening portion be formed in a region of the vibrating plate that is positioned between the frame portion and an outermost node among nodes of vibration of the vibrating plate.

Since the vibrating portion is flexibly elastically supported with respect to the frame portion by the plurality of connecting portions, a frame-portion-side end of the vibrating portion also vibrates freely. In this structure, since the opening portion is formed in the aforementioned region, the outermost node among the nodes of vibration of the vibrating plate defines the outer periphery of the first blower chamber. That is, the shortest distance a from the central axis of the first blower chamber to the outer periphery of the first blower chamber is determined by the opening portion.

Therefore, the blower having this structure can prevent a reduction in discharge pressure and discharge flow rate even if the vibrating plate includes the vibrating portion, the frame portion, and the connecting portions.

It is desirable that the opening portion be formed in a region of the housing opposing a region of the vibrating plate that is positioned between the frame portion and an outermost node among nodes of vibration of the vibrating plate.

Since the vibrating portion is flexibly elastically supported with respect to the frame portion by the plurality of connecting portions, a frame-portion-side end of the vibrating portion also vibrates freely. In this structure, since the opening portion is formed in the aforementioned region, the outermost node among the nodes of vibration of the vibrating plate defines the outer periphery of the first blower chamber. That is, the shortest distance a from the central axis of the first blower chamber to the outer periphery of the first blower chamber is determined by the opening portion.

Therefore, the blower having this structure can prevent a reduction in discharge pressure and discharge flow rate even if the vibrating plate includes the vibrating portion, the frame portion, and the connecting portions.

It is desirable that the driving member be a piezoelectric member.

It is desirable that the housing include a first movable portion that opposes the second principal surface of the vibrating plate and that undergoes bending vibration as the vibrating plate undergoes the bending vibration.

In this structure, since the first movable portion vibrates as the vibrating plate vibrates, it is possible to essentially increase vibration amplitude. Therefore, the blower according to the present disclosure can further increase discharge pressure and discharge flow rate.

It is desirable that the housing form, together with the actuator, a second blower chamber such that the second blower chamber is interposed therebetween in the thickness direction of the vibrating plate, and include a second vent hole that allows a center of the second blower chamber to communicate with an outside of the second blower chamber, the vibrating plate include the opening portion that allows the outer periphery of the first blower chamber to communicate with an outer periphery of the second blower chamber, and a shortest distance from a central axis of the second blower chamber to the outer periphery of the second blower chamber be equal to the shortest distance a.

In this structure, the vibrating plate and the housing are formed such that the shortest distances of the first blower chamber and the second blower chamber are a. The driving member causes the vibrating plate to vibrate at the resonance frequency f.

According to the blower having this structure, when driving the actuator, the gas in the first blower chamber is discharged to the outside of the housing through the first vent hole, and gas in the second blower chamber is discharged to the outside of the housing through the second vent hole.

In this structure, when the vibrating plate vibrates, gas at the outer periphery of the first blower chamber and gas at the outer periphery of the second blower chamber move through the opening portion. Therefore, when the vibrating plate vibrates, the pressure at the outer periphery of the first blower chamber and the pressure at the outer periphery of the second blower chamber cancel each other through the opening portion, and are atmospheric pressure (nodes) at all times.

Here, when $af=(k_0c)/(2\pi)$, the outermost node among the nodes of vibration of the vibrating plate coincides with the node of pressure vibration of the first blower chamber and a node of pressure vibration of the second blower chamber, and pressure resonance occurs. Further, even when the relationship of $0.8\times(k_0c)/(2\pi)\leq af\leq 1.2\times(k_0c)/(2\pi)$ is satisfied, the outermost node among the nodes of vibration of the vibrating plate substantially coincides with the node of pressure vibration of the first blower chamber and the node of pressure vibration of the second blower chamber.

Therefore, when the relationship of $0.8\times(k_0c)/(2\pi)\leq af\leq 1.2\times(k_0c)/(2\pi)$ is satisfied, the blower having this structure can realize high discharge pressure and high discharge flow rate at the first vent hole and the second vent hole.

It is desirable that the second vent hole in the housing be provided with a second valve that prevents the gas from flowing into the second blower chamber from the outside of the second blower chamber.

In this structure, it is possible to prevent gas from flowing into the second blower chamber from the outside of the second blower chamber through the second vent hole by using the valve. Therefore, the blower having this structure can realize high discharge pressure and high discharge flow rate.

It is desirable that, in a range from the central axis of the second blower chamber to the outer periphery of the second blower chamber, the number of zero crossover points of vibration displacement of the vibrating plate be equal to the number of zero crossover points of pressure change in the second blower chamber. Here, each point on the vibrating plate from the central axis of the second blower chamber to the outer periphery of the second blower chamber is displaced by vibration. In addition, from the central axis of the second blower chamber to the outer periphery of the second blower chamber, the pressure at each point at the second blower chamber due to the vibrating plate being vibrated.

In this structure, when the vibrating plate vibrates, the distribution of the displacements of the respective points on the vibrating plate becomes a distribution that is close to a distribution of the pressure changes at the respective points at the second blower chamber. That is, when the vibrating plate vibrates, the points on the vibrating plate are displaced in accordance with the pressure changes at the respective points at the second blower chamber.

Therefore, the blower having this structure is capable of transmitting vibration energy of the vibrating plate to the gas in the second blower chamber almost without loss of the vibration energy of the vibrating plate. Therefore, the blower having this structure can realize high discharge pressure and high discharge flow rate.

A pressure change distribution u(r) of the points at the second blower chamber is expressed by the formula $u(r)=J_0(k_0r/a)$, where the distance from the central axis of the second blower chamber is r.

It is desirable that the housing include a third vent hole that allows the outer periphery of at least one of the first blower chamber and the second blower chamber to communicate with an outside of the housing.

In this structure, when the vibrating plate vibrates, gas that is outside of the housing flows into at least one of the first blower chamber and the second blower chamber through the third vent hole.

It is desirable that the housing include a second movable portion that opposes the first principal surface of the vibrating plate and that undergoes bending vibration as the vibrating plate undergoes the bending vibration.

In this structure, since the second movable portion vibrates as the vibrating plate vibrates, it is possible to essentially increase vibration amplitude. Therefore, the blower according to the present disclosure can further increase discharge pressure and discharge flow rate.

According to the present disclosure, it is possible to prevent a reduction in discharge pressure and discharge flow rate even if a large opening portion is provided for ensuring sufficient flow rate.

Figure 1:
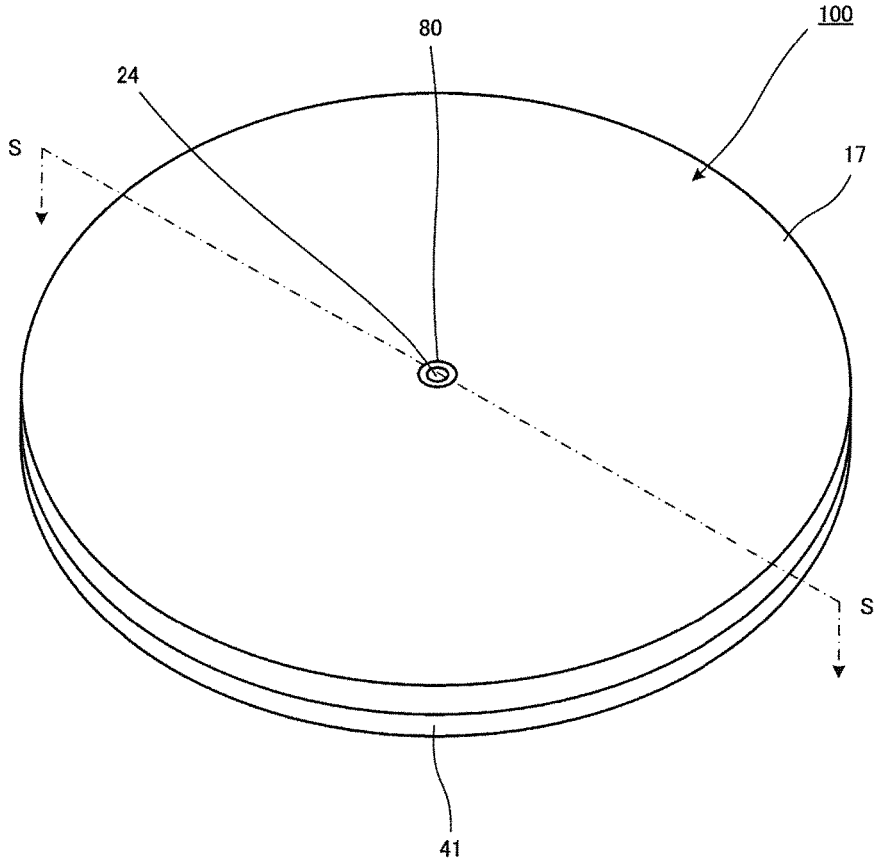
FIG. 1 is an external perspective view of a piezoelectric blower 100 according to a first embodiment of the present disclosure.
Figure 4A:
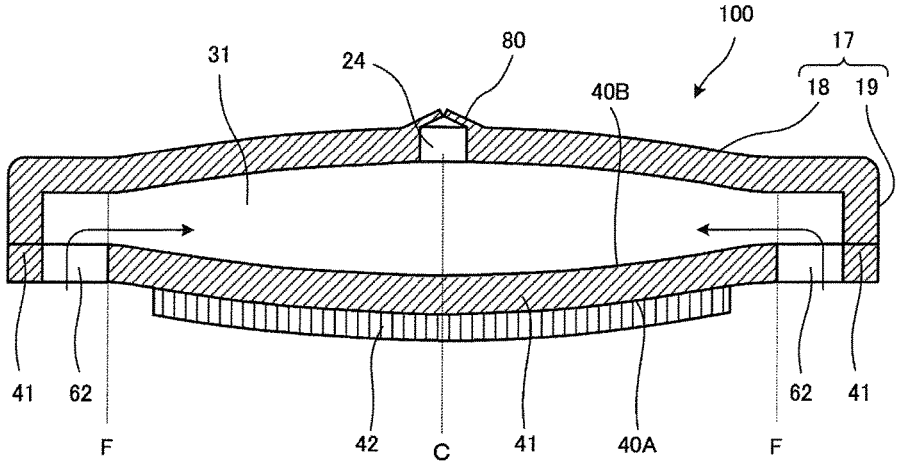
Figure 4B:
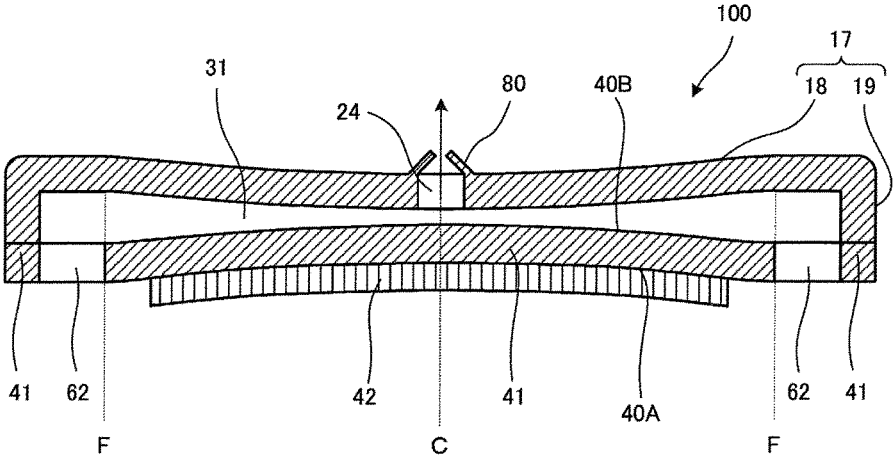

Each of FIGS. 4A and 4B is a sectional view taken along line S-S of the piezoelectric blower 100 shown in FIG. 1 when the piezoelectric blower 100 operates at a first-order mode frequency (fundamental).

Figure 5:
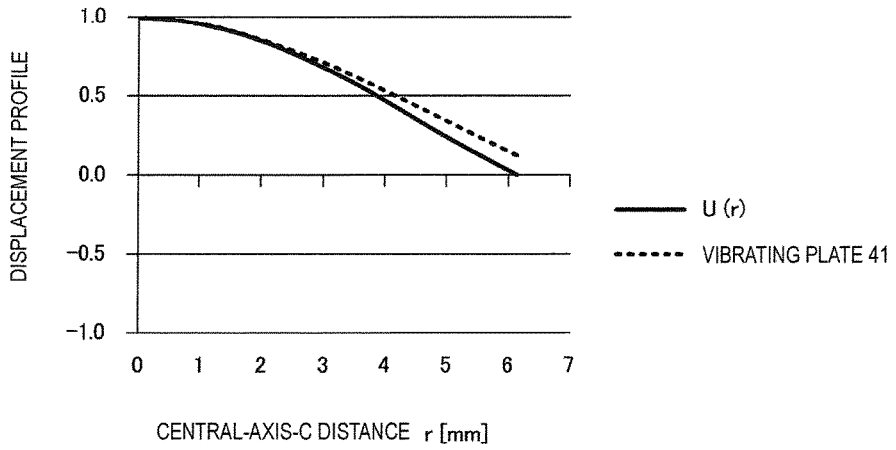

FIG. 5 shows the relationship between pressure change at each point at a blower chamber 31 and displacement of each point on a vibrating plate 41 in the piezoelectric blower 100 shown in FIG. 1.

Figure 6:
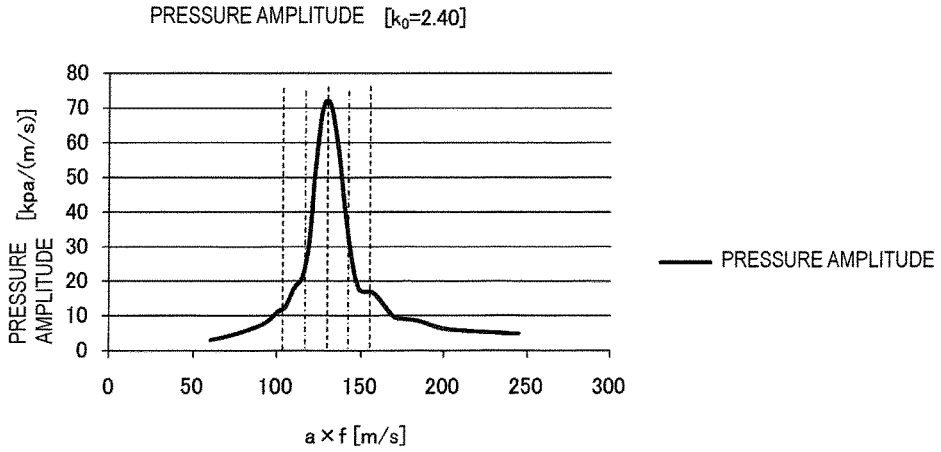

FIG. 6 shows the relationship between radius a×resonance frequency f and pressure amplitude in the piezoelectric blower 100 shown in FIG. 1.

Figure 7:
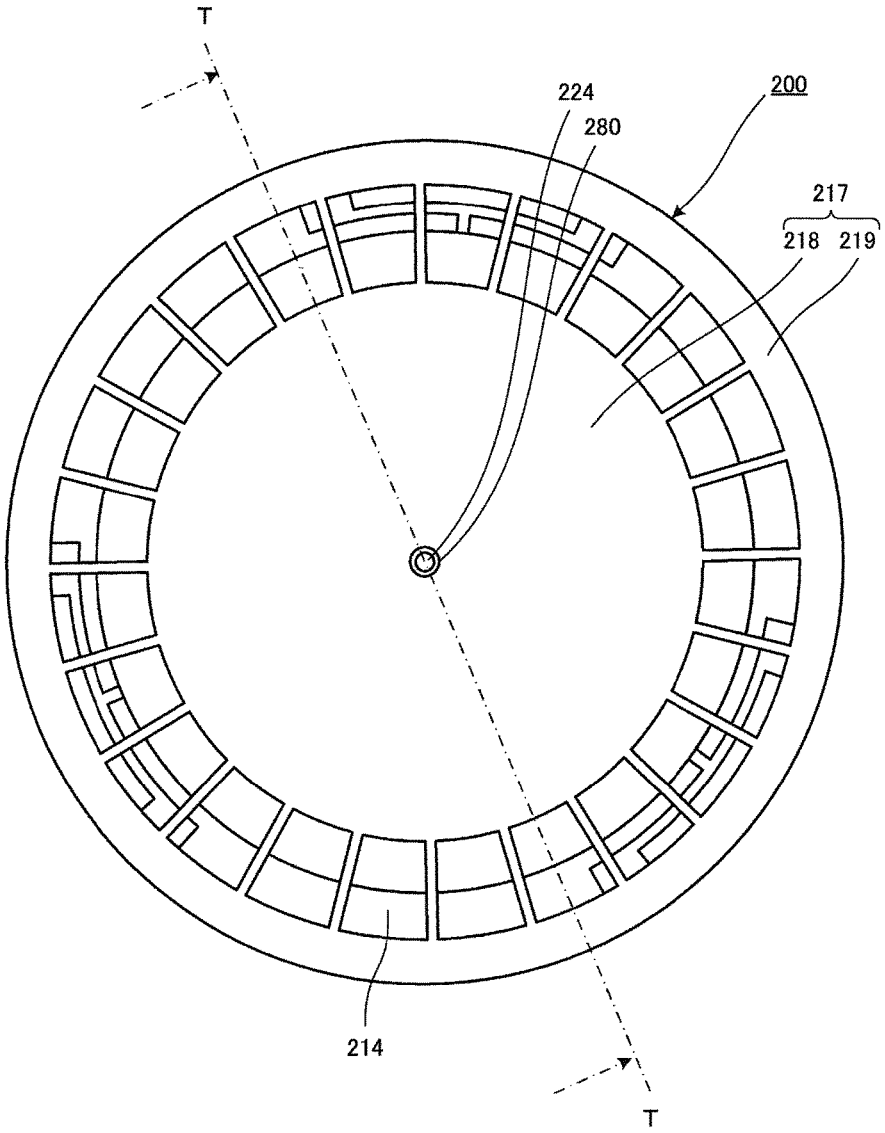

FIG. 7 is a plan view of a piezoelectric blower 200 according to a second embodiment of the present disclosure.

Figure 8:
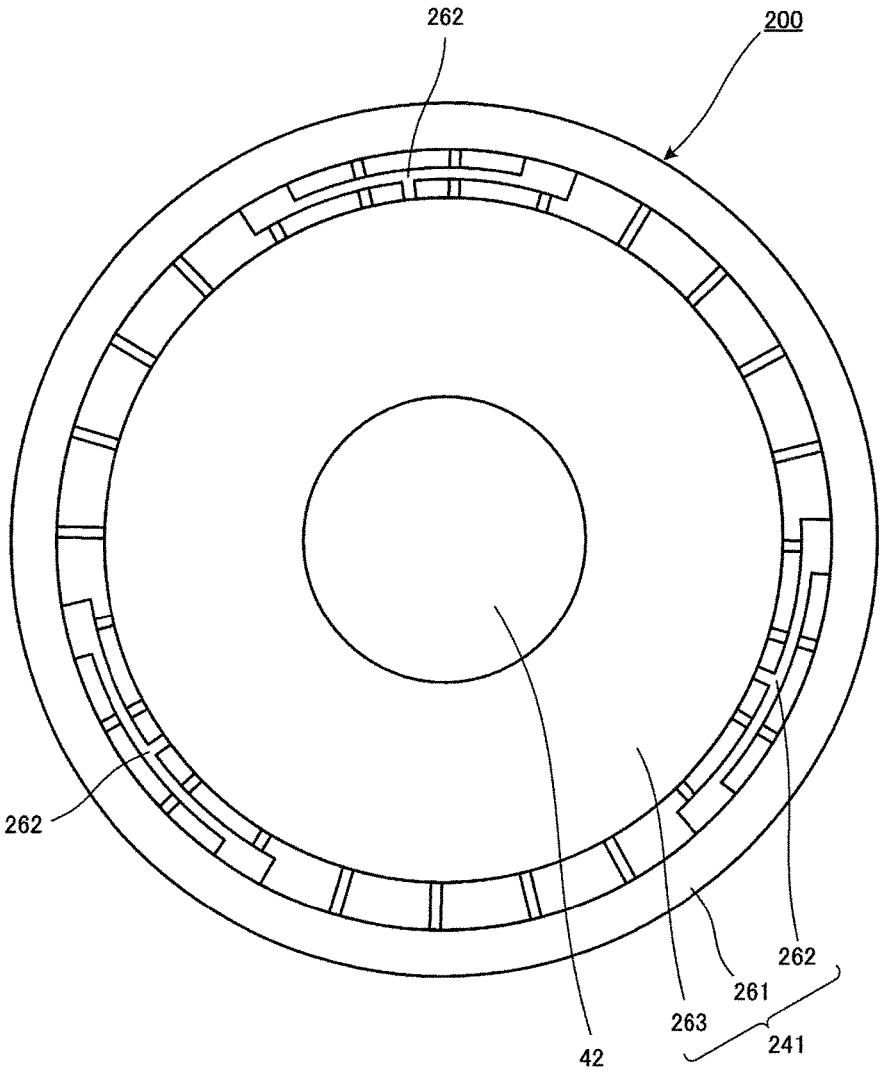

FIG. 8 is a back view of the piezoelectric blower 200 shown in FIG. 7.

Figure 9:
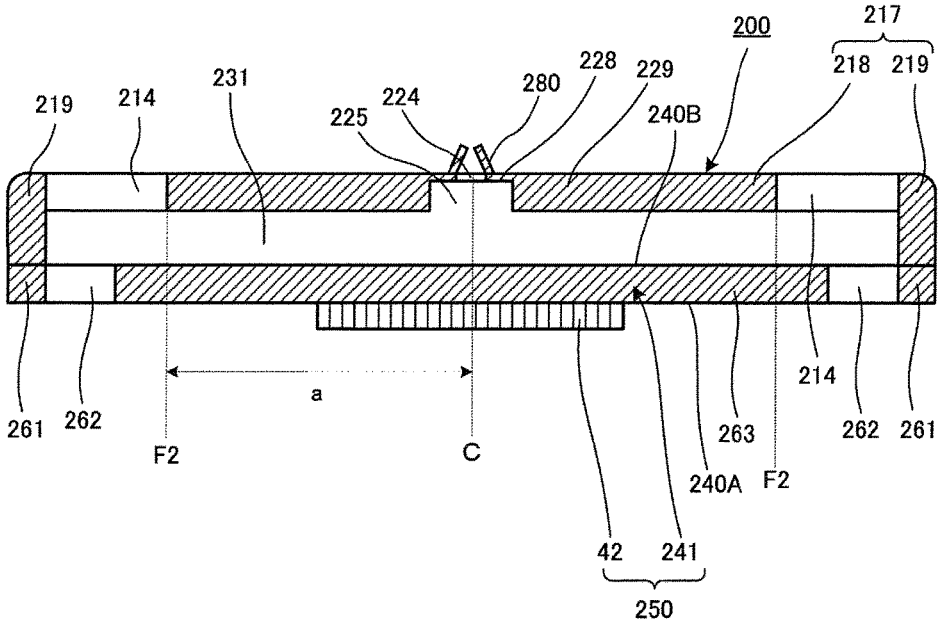

FIG. 9 is a sectional view taken along line T-T of the piezoelectric blower 200 shown in FIG. 7.

Figure 10A:
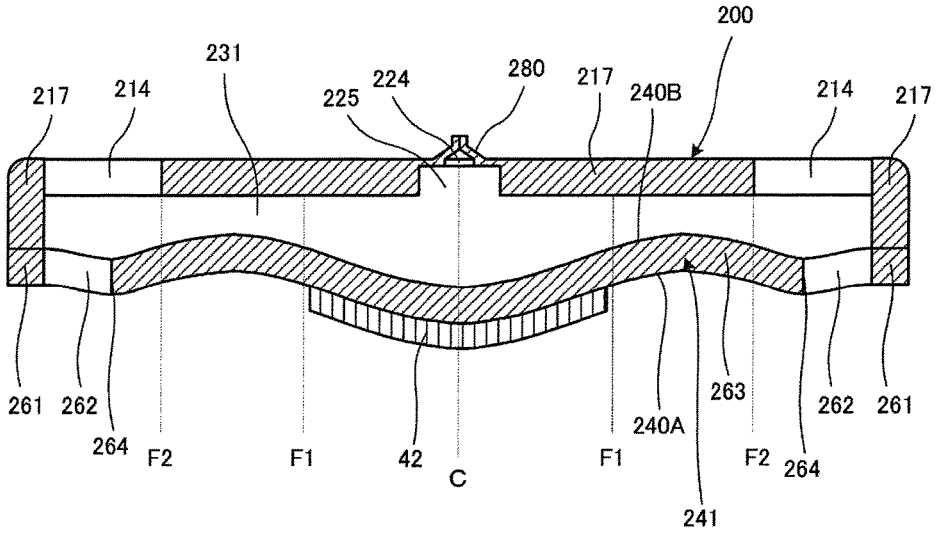
Figure 10B:
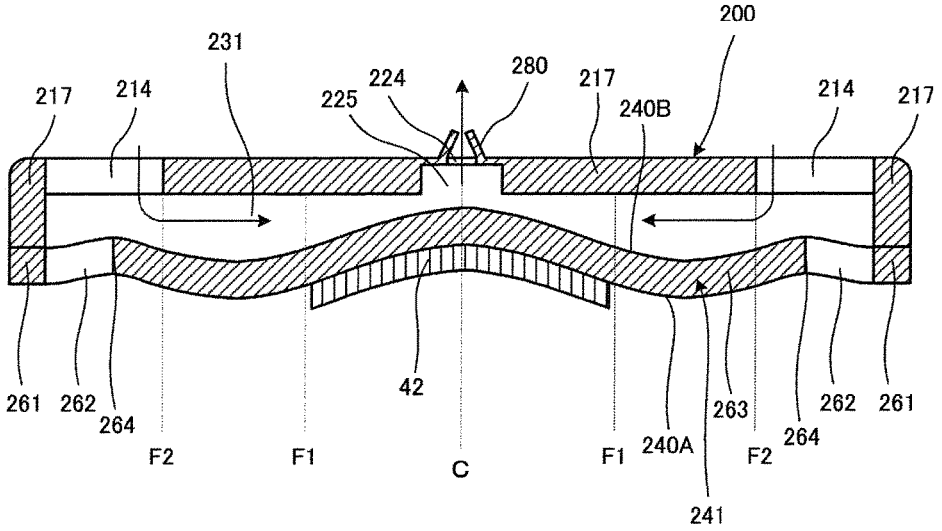

Each of FIGS. 10A and 10B is a sectional view taken along line T-T of the piezoelectric blower 200 shown in FIG. 7 when the piezoelectric blower 200 operates at a third-order mode frequency (triple of the fundamental).

Figure 11:
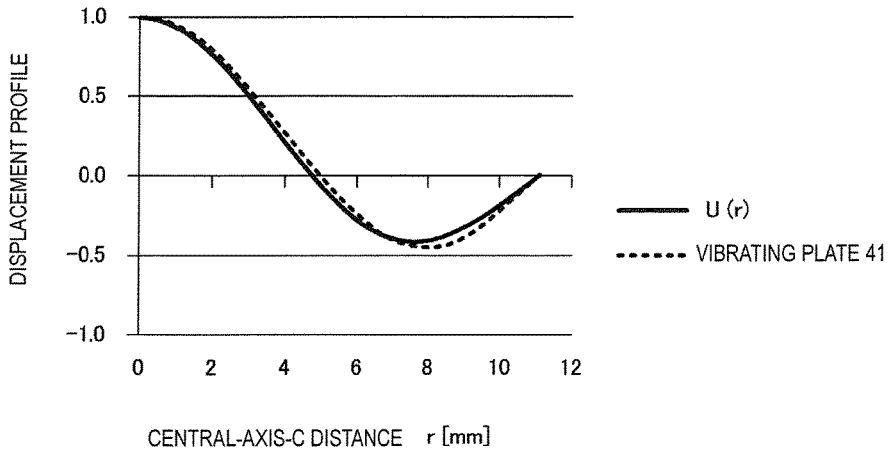

FIG. 11 shows the relationship between pressure change at each point at a blower chamber 31 and displacement of each point on a vibrating plate 41 in the piezoelectric blower 200 shown in FIG. 7.

Figure 12:
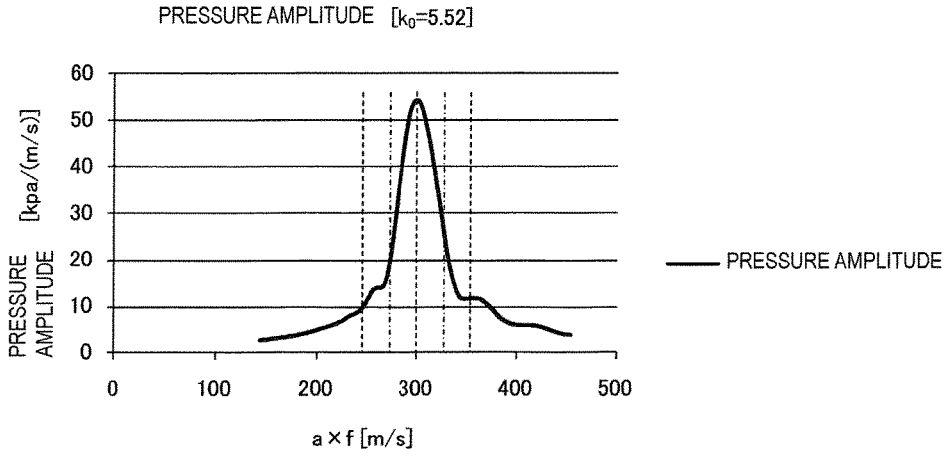

FIG. 12 shows the relationship between radius a×resonance frequency f and pressure amplitude in the piezoelectric blower 200 shown in FIG. 7.

Figure 13:
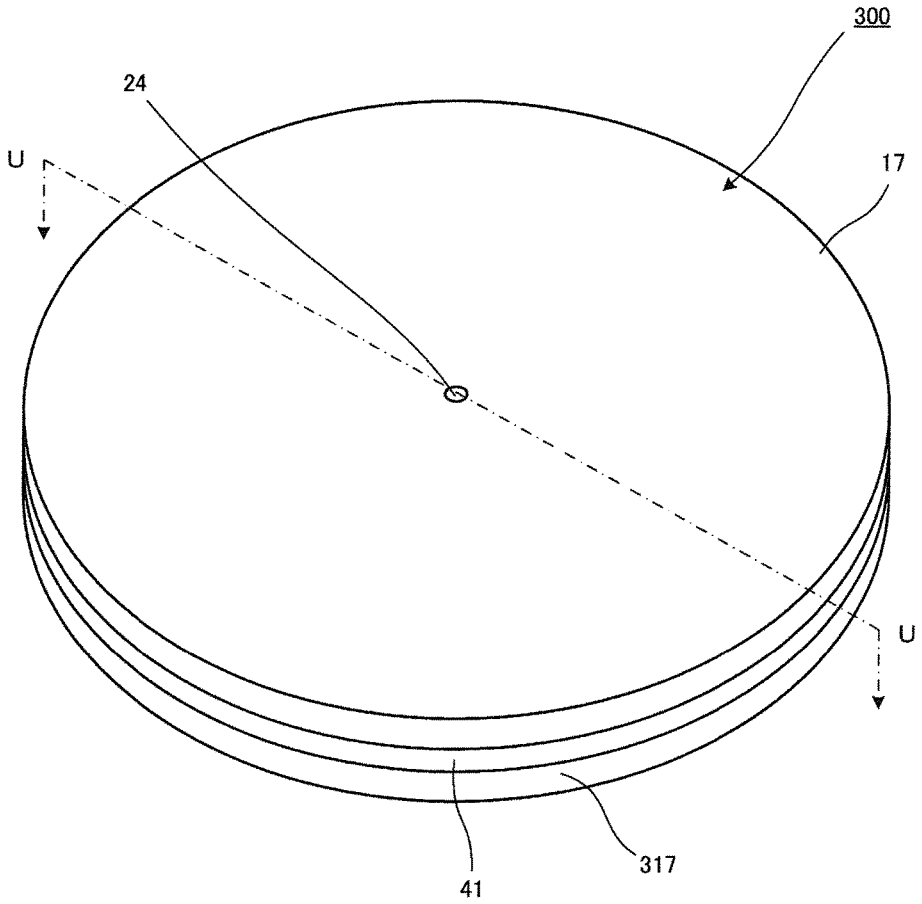

FIG. 13 is an external perspective view of a piezoelectric blower 300 according to a third embodiment of the present disclosure.

Figure 14:
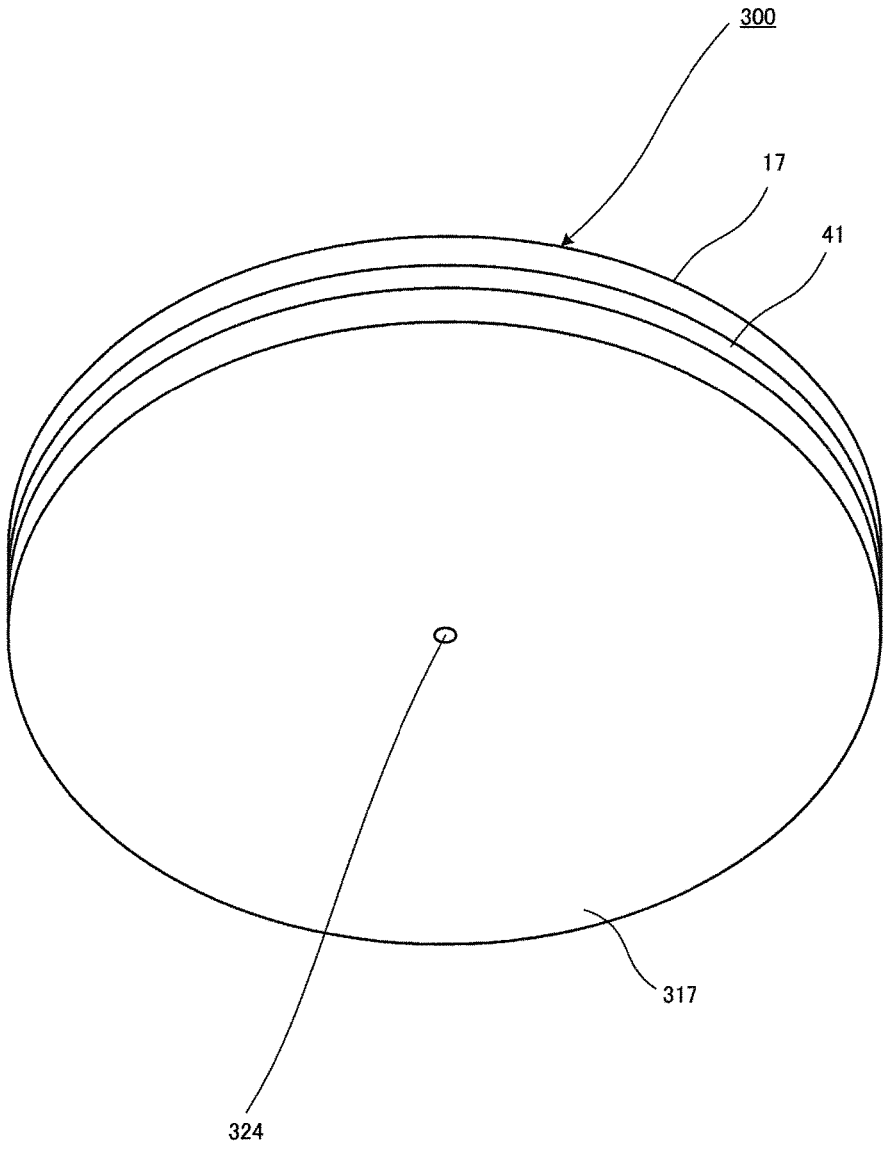

FIG. 14 is an external perspective view of the piezoelectric blower 300 shown in FIG. 13.

Figure 15:
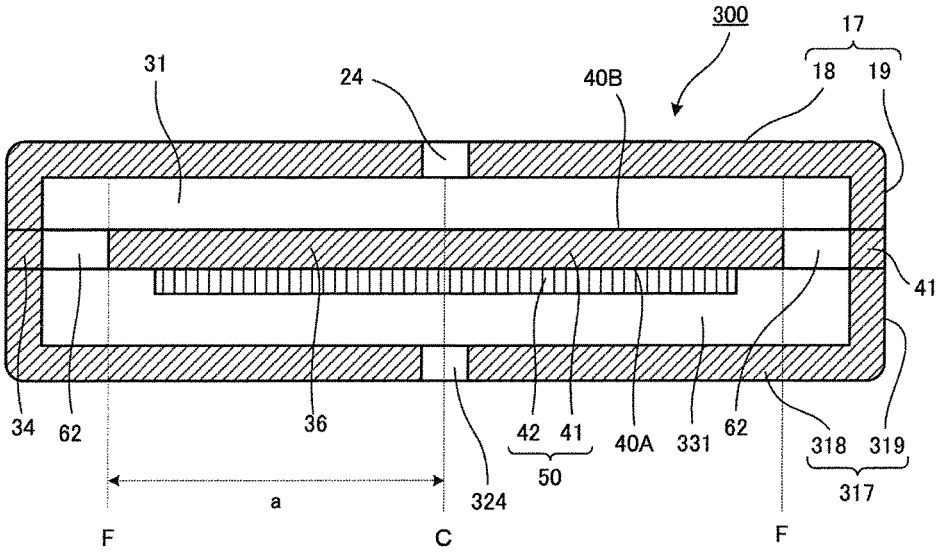

FIG. 15 is a sectional view taken along line U-U of the piezoelectric blower 300 shown in FIG. 13.

Figure 16A:
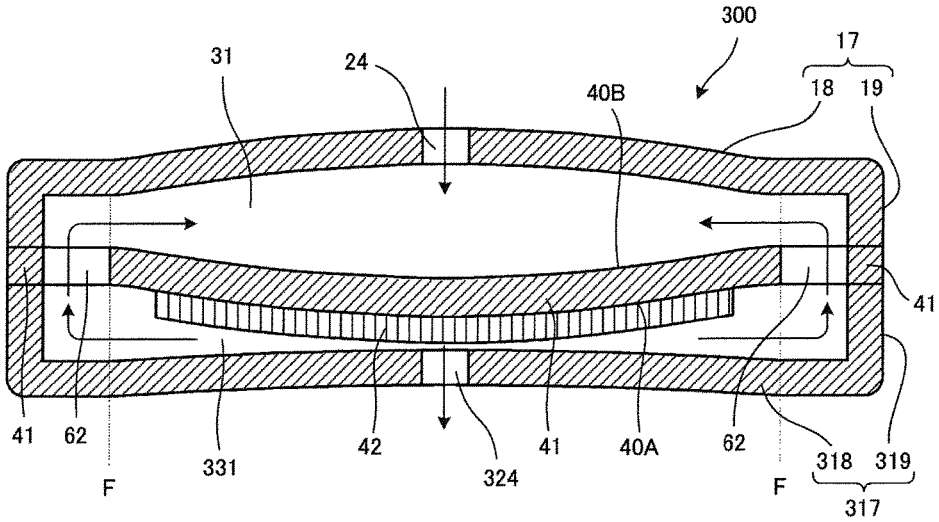
Figure 16B:
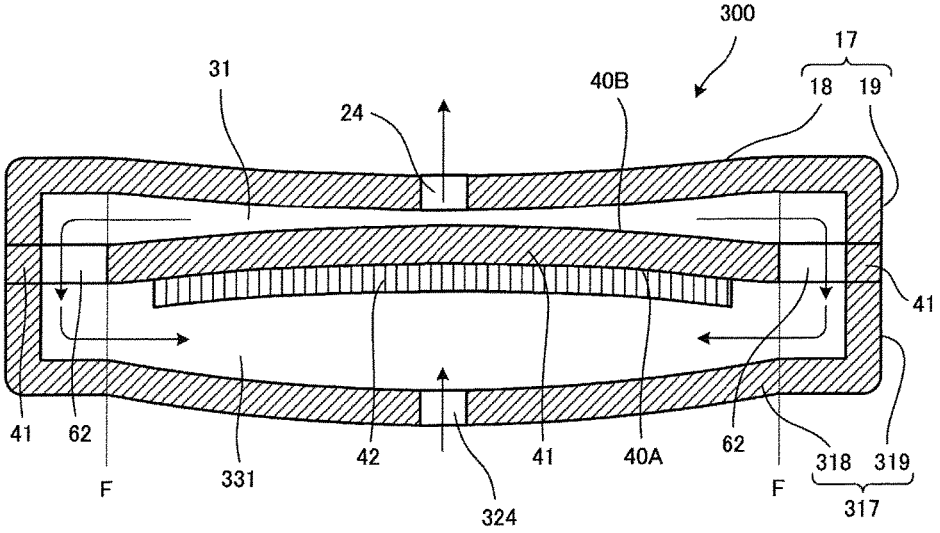

Each of FIGS. 16A and 16B is a sectional view taken along line U-U of the piezoelectric blower 300 shown in FIG. 13 when the piezoelectric blower 300 operates at a first-order mode frequency (fundamental).

Figure 17:
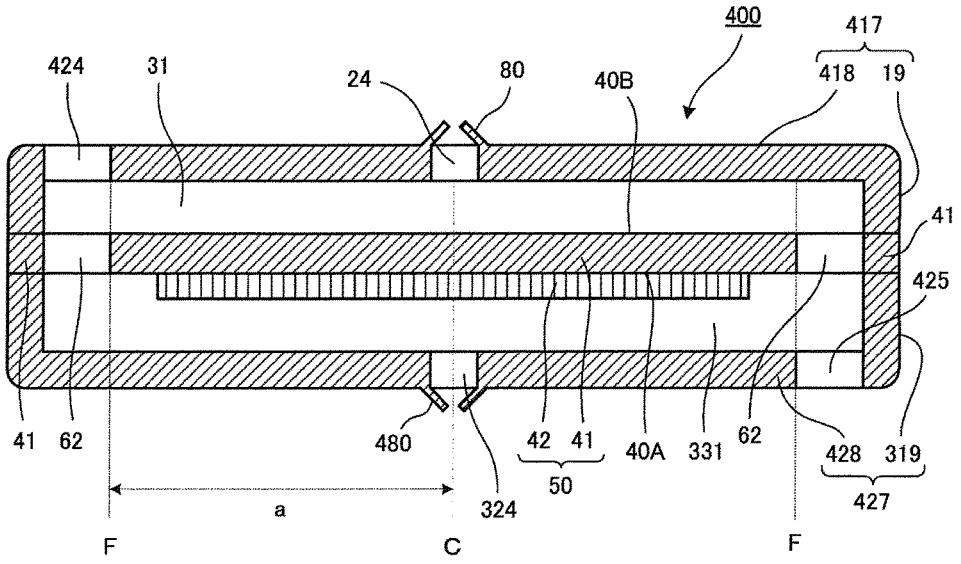

FIG. 17 is an external perspective view of a piezoelectric blower 400 according to a fourth embodiment of the present disclosure.

Figure 18A:
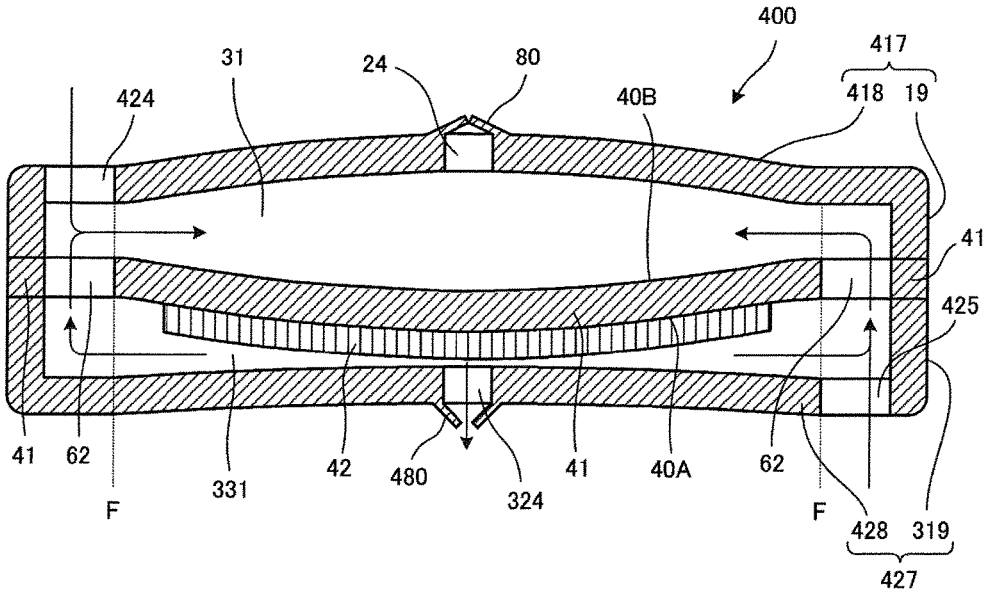
Figure 18B:
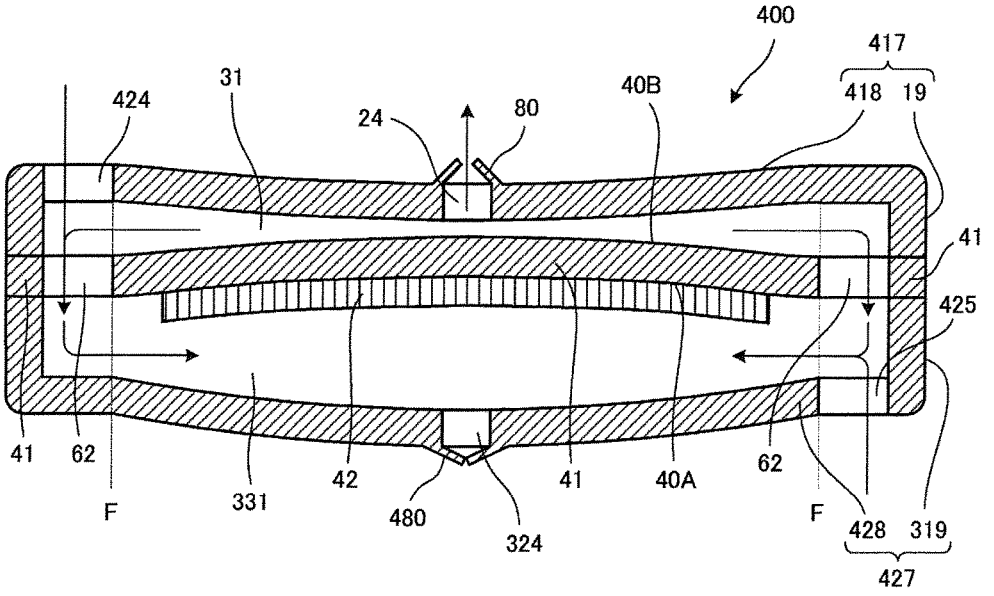

Each of FIGS. 18A and 18B is a sectional view of the piezoelectric blower 400 shown in FIG. 17 when the piezoelectric blower 400 operates at a first-order mode frequency (fundamental).

Figure 19:
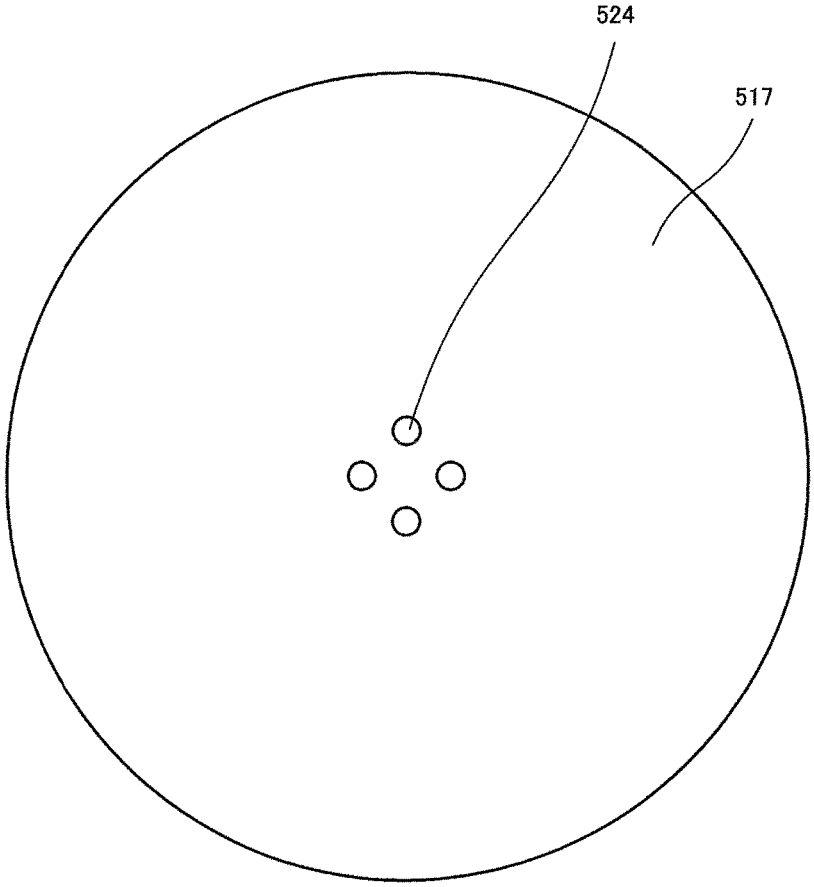

FIG. 19 is a plan view of a housing 517 according to a first modification of a housing 17 shown in FIG. 1.

Figure 20:
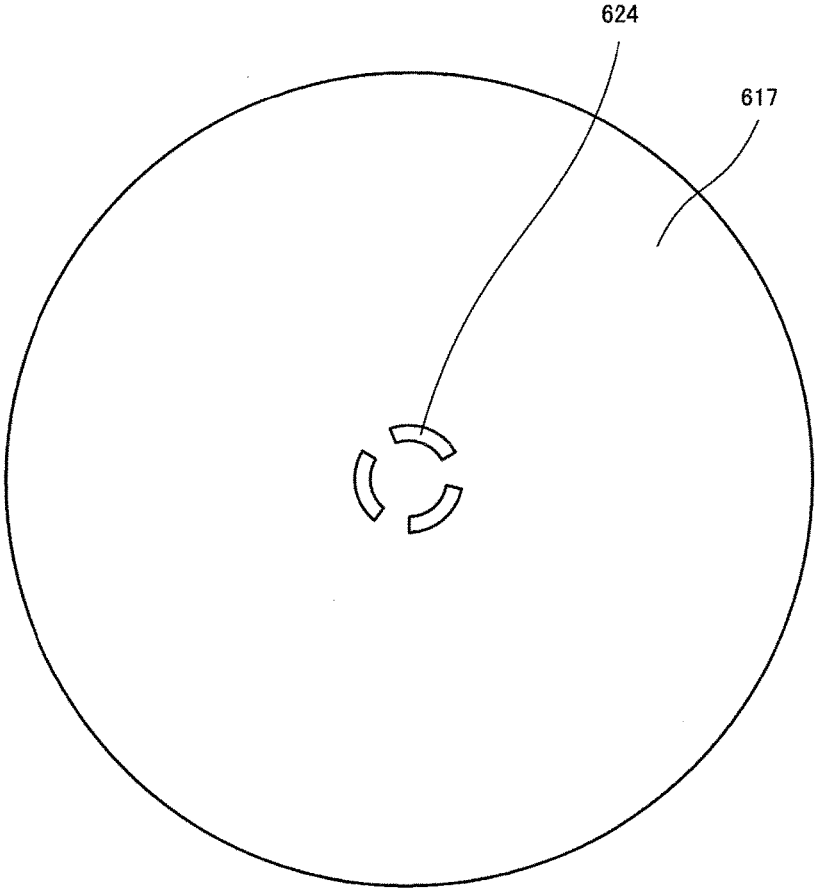

FIG. 20 is a plan view of a housing 617 according to a second modification of the housing 17 shown in FIG. 1.

Figure 21:
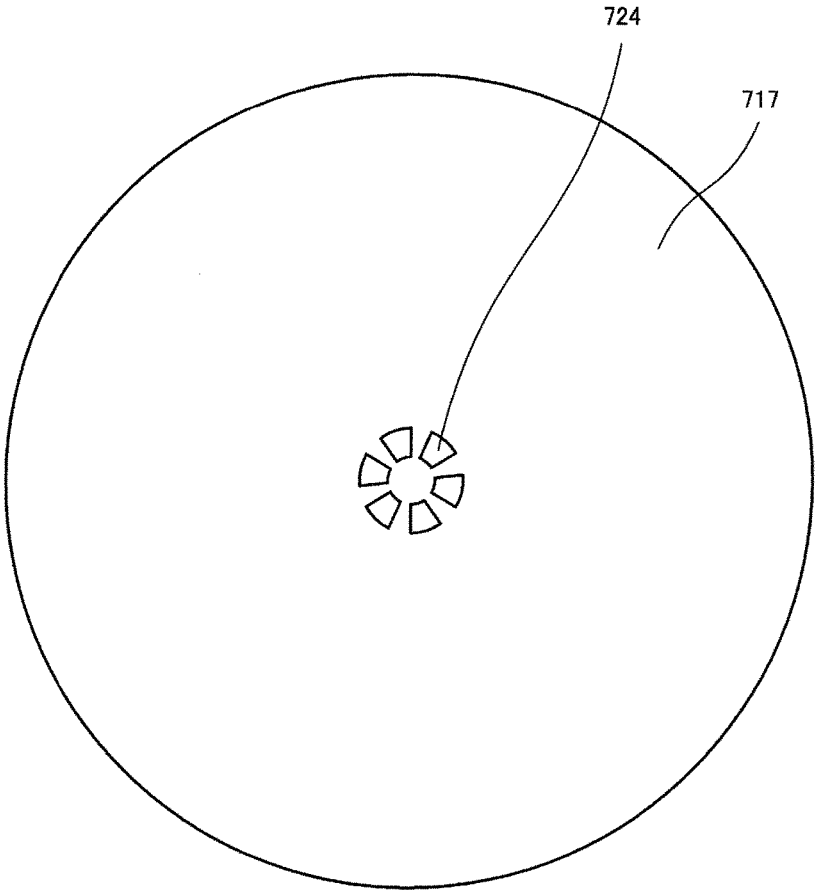

FIG. 21 is a plan view of a housing 717 according to a third modification of the housing 17 shown in FIG. 1.

Figure 22:
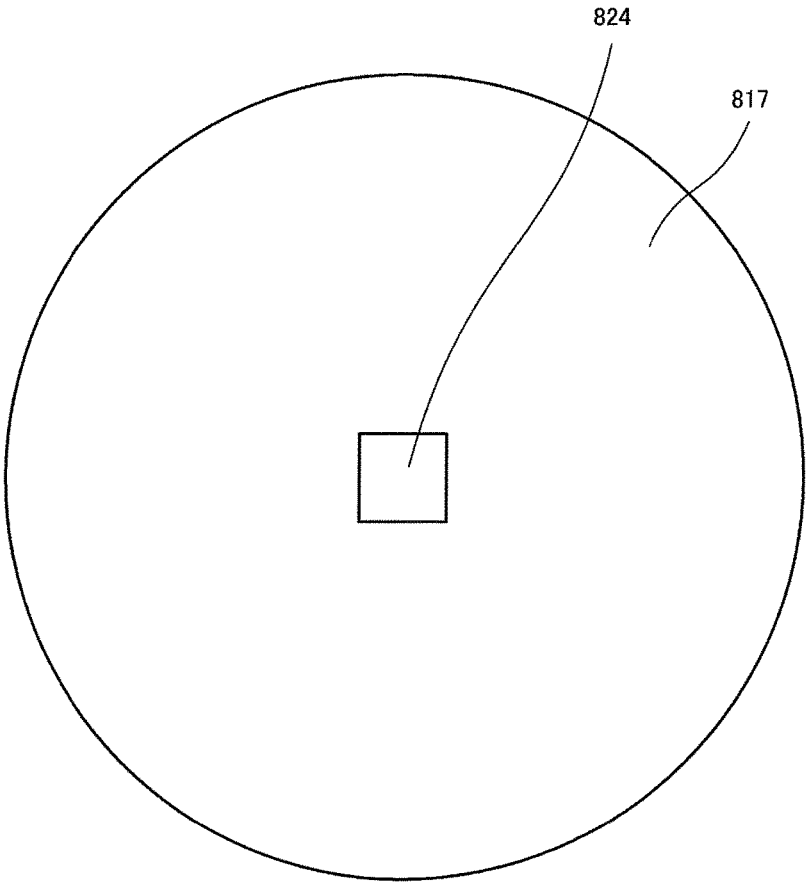

FIG. 22 is a plan view of a housing 817 according to a fourth modification of the housing 17 shown in FIG. 1.

DETAILED DESCRIPTION OF THE DISCLOSURE

«First Embodiment of the Present Disclosure»

A piezoelectric blower 100 according to a first embodiment of the present disclosure is described below.

Figure 2:
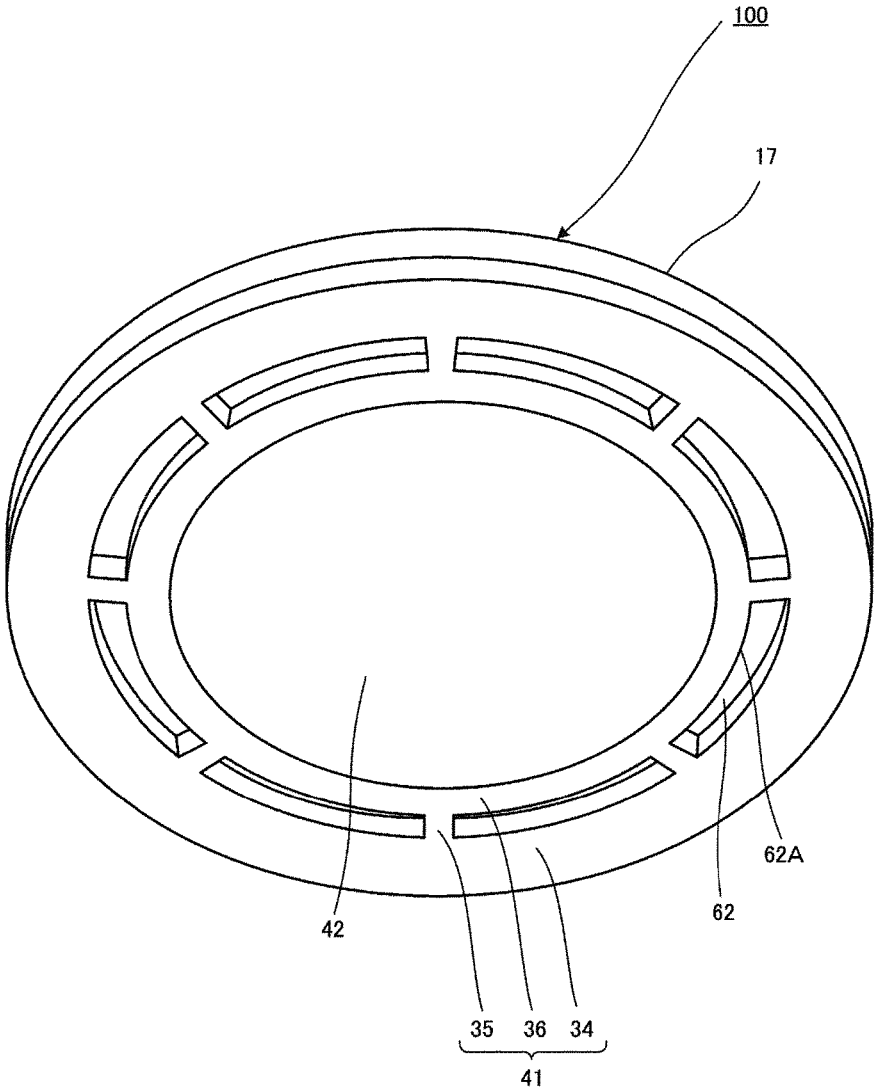
FIG. 2 is an external perspective view of the piezoelectric blower 100 shown in FIG. 1.
Figure 3:
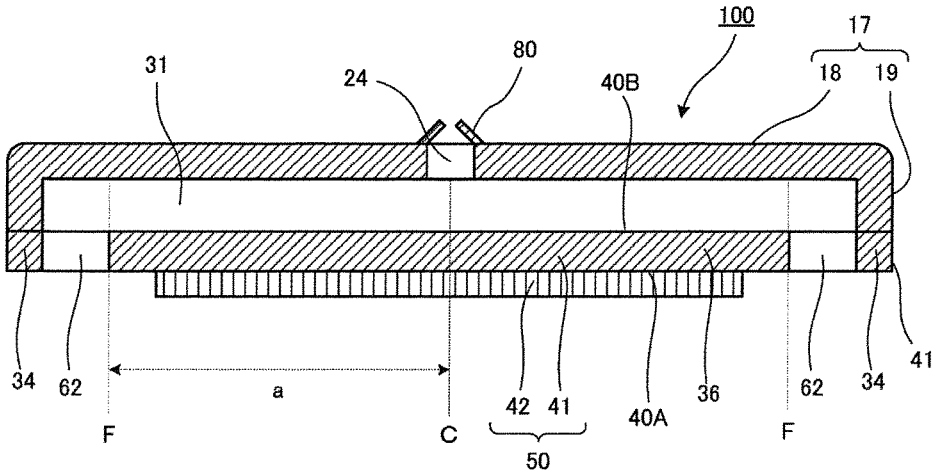
FIG. 3 is a sectional view taken along line S-S of the piezoelectric blower 100 shown in FIG. 1.

FIG. 1 is an external perspective view of the piezoelectric blower 100 according to the first embodiment of the present disclosure. FIG. 2 is an external perspective view of the piezoelectric blower 100 shown in FIG. 1. FIG. 3 is a sectional view taken along line S-S of the piezoelectric blower 100 shown in FIG. 1.

The piezoelectric blower 100 includes a valve 80, a housing 17, a vibrating plate 41, and a piezoelectric element 42 in that order from the top, and has a structure in which these components are successively placed upon each other.

In this embodiment, the piezoelectric element 42 corresponds to a "driving member" according to the present disclosure.

The vibrating plate 41 is disc-shaped, and is made of, for example, stainless steel (SUS). The thickness of the vibrating plate 41 is, for example, 0.6 mm. The diameter of a vent hole 24 is, for example, 0.6 mm. The vibrating plate 41 includes a first principal surface 40A and a second principal surface 40B.

The second principal surface 40B of the vibrating plate 41 is joined to ends of the housing 17. By this, the vibrating plate 41 forms, together with the housing 17, a column-shaped blower chamber 31 such that the blower chamber 31 is interposed therebetween in a thickness direction of the vibrating plate 41. The vibrating plate 41 and the housing 17 are formed such that the blower chamber 31 has a radius a. For example, in the embodiment, the radius a of the blower chamber 31 is 6.1 mm.

Further, the vibrating plate 41 includes opening portions 62 that allow an outer periphery of the blower chamber 31 to communicate with the outside of the blower chamber 31. As shown in FIG. 2, each opening portion has the shape of a fan having an arc 62A. The opening portions 62 are formed along substantially the entire periphery of the vibrating plate 41 so as to surround the blower chamber 31. By this, the vibrating plate 41 includes an outer peripheral portion 34, a plurality of beam portions 35, and a vibrating portion 36. The outer peripheral portion 34 is ring-shaped. The vibrating portion 36 is disc-shaped. The vibrating portion 36 is disposed within an opening of the outer peripheral portion 34 while the vibrating portion 36 is spaced apart from the outer peripheral portion 34. The plurality of beams portions 35 are provided between the outer peripheral portion 34 and the vibrating portion 36, and connect the vibrating portion 36 and the outer peripheral portion 34 to each other.

Therefore, the vibrating portion 36 is supported within a hollow through the beam portions 35, and is vertically movable in the thickness direction.

The blower chamber 31 refers to a space that exists inwardly from the opening portions 62 (more precisely, a space that is exists inwardly from a ring formed by connecting all of the opening portions 62) when the second principal surface 40B of the vibrating plate 41 is viewed from the front. Therefore, a region that exists inwardly from the opening portions 62 at the second principal surface 40B of the vibrating plate 41 (more precisely, the vent-hole-24-side principal surface of the vibrating portion 36 that exists inwardly from the ring that is formed by connecting all of the opening portions 62) forms a bottom surface of the blower chamber 31. The vibrating plate 41 is formed by, for example, punching a metallic plate.

The piezoelectric element 42 is disc-shaped, and is made of, for example, a lead zirconate titanate ceramic. Electrodes are formed on both principal surfaces of the piezoelectric element 42. The piezoelectric element 42 is joined to the first principal surface 40A of the vibrating plate 41 that is disposed opposite to the blower chamber 31, and expands and contracts in accordance with an applied alternating voltage. A joined body including the piezoelectric element 42 and the vibrating plate 41 that are joined to each other forms a piezoelectric actuator 50.

The housing 17 has a C-shaped cross section having an open bottom. The ends of the housing 17 are joined to the vibrating plate 41. The housing 17 is made of, for example, a metal.

The housing 17 includes a disc-shaped top plate portion 18 opposing the second principal surface 40B of the vibrating plate 41 and a ring-shaped side wall portion 19 that is connected to the top plate portion 18. A portion of the top plate portion 18 forms a top surface of the blower chamber 31.

In the embodiment, the blower chamber 31 corresponds to a "first blower chamber" according to the present disclosure. The top plate portion 18 corresponds to a "first movable portion" according to the present disclosure.

The top plate portion 18 includes the column-shaped vent hole 24 that allows a central portion of the blower chamber 31 to communicate with the outside of the blower chamber 31. The central portion of the blower chamber 31 is a portion that overlaps the piezoelectric element 42 when the first principal surface 40A of the vibrating plate 41 is viewed from the front. The top plate portion 18 is provided with a valve 80 that prevents gas from flowing into the blower chamber 31 from the outside of the blower chamber 31 through the vent hole 24.

In the embodiment, the vent hole 24 corresponds to a "first vent hole" according to the present disclosure. The valve 80 corresponds to a "first valve" according to the present disclosure.

The flow of air when the piezoelectric blower 100 operates is described below.

FIGS. 4A and 4B are sectional views taken along line S-S of the piezoelectric blower 100 shown in FIG. 1 when the piezoelectric blower 100 operates at a first-order mode resonance frequency (fundamental). FIG. 4A illustrates a case in which the volume of the blower chamber 31 has been maximally increased, and FIG. 4B illustrates a case in which the volume of the blower chamber 31 has been maximally reduced. Here, the illustrated arrows denote the flow of air.

FIG. 5 shows the relationship between pressure change at each point at the blower chamber 31 from a central axis C of the blower chamber 31 to the outer periphery of the blower chamber 31 and displacement of each point on the vibrating plate 41 from the central axis C of the blower chamber 31 to the outer periphery of the blower chamber 31, at a moment when the piezoelectric blower 100 shown in FIG. 1 is set in the state shown in FIG. 4B. FIG. 5 is obtained by simulation.

Here, in FIG. 5, the pressure change at each point at the blower chamber 31 and the displacement of each point on the vibrating plate 41 are indicated by a value that has been standardized based on the displacement of the center of the vibrating plate 41 existing on the central axis C of the blower chamber 31. A pressure change distribution u(r) of the points at the blower chamber 31 is described later.

FIG. 6 shows the relationship between radius a×resonance frequency f and pressure amplitude in the piezoelectric blower 100 shown in FIG. 1. FIG. 6 is a figure in which the pressure amplitude is obtained by varying radius a×resonance frequency f by simulation. The dotted lines in FIG. 6 indicate a maximum value, and a lower limit and an upper limit of a range satisfying the relationship of $0.8\times(k_0c)/(2\pi)\leq af\leq 1.2\times(k_0c)/(2\pi)$. The lower limit value is 104 m/s, the upper limit value is 156 m/s, and the maximum value is 130 m/s.

Similarly, the alternate long and short dashed lines in FIG. 6 indicate a lower limit and an upper limit of a range satisfying the relationship of $0.9\times(k_0c)/(2\pi)\leq af\leq 1.1\times(k_0c)/(2\pi)$. The lower limit value is 117 m/s, and the upper limit value is 143 m/s.

The pressure amplitude shown in FIG. 6 is standardized based on the vibration speed of a central portion of the piezoelectric element 42. Since the fracture limitation of the piezoelectric element 42 becomes the upper limit, the pressure amplitude when the vibration speed=1 m/s is graphed in the measurement shown in FIG. 6.

When, in the state shown in FIG. 3, an alternating drive voltage with the first-order mode frequency (fundamental) is applied to the electrodes on the two principal surfaces of the piezoelectric element 42, the piezoelectric element 42 expands and contracts and causes the vibrating plate 41 to undergo concentric bending vibration at the first-order mode resonance frequency f.

At the same time, due to pressure variations in the blower chamber 31 resulting from the bending vibration of the vibrating plate 41, the top plate portion 18 undergoes concentric bending vibration in the first-order mode as the vibrating plate 41 undergoes the bending vibration (in this embodiment, such that the vibration phase lags by 180 degrees).

By this, as shown in FIGS. 4A and 4B, the vibrating plate 41 and the top plate portion 18 are bent, as a result of which the volume of the blower chamber 31 changes periodically.

The radius a of the blower chamber 31 and the resonance frequency f of the vibrating plate 41 satisfy the relationship of $0.8\times(k_0c)/(2\pi)\leq af\leq 1.2\times(k_0c)/(2\pi)$, where the acoustic velocity of air that passes through the blower chamber 31 is c and a value that satisfies the relationship of the Bessel function of the first kind of $J_0(k_0)=0$ is $k_0$.

In the embodiment, for example, the resonance frequency f of the vibrating plate 41 is 21 kHz. The resonance frequency f of the vibrating plate 41 is determined by, for example, the thickness of the vibrating plate 41 and the material of the vibrating plate 41. The acoustic velocity c of air is 340 m/s. $k_0$ is 2.40. The Bessel function of the first kind $J_0(x)$ is expressed by the following numerical formula.

[Formula 1]

$$J_0(x)=\sum_{m=0}^{\infty}\frac{(-1)^m}{m!\Gamma(m+1)}\left(\frac{x}{2}\right)^{2m} \qquad \text{Formula 1}$$

The pressure change distribution u(r) of the points at the blower chamber 31 is expressed by the formula $u(r)=J_0(k_0r/a)$, where the distance from the central axis C of the blower chamber 31 is r.

As shown in FIG. 4A, when the vibrating plate 41 bends towards the piezoelectric element 42, the top plate portion 18 also bends towards a side opposite to the piezoelectric element 42, so that the volume of the blower chamber 31 is increased. At this time, since the pressure at the central portion of the blower chamber 31 is reduced and the valve 80 is closed, air does not enter and exit at a vent-hole-24 portion. This causes air that exists outside of the piezoelectric blower 100 to be sucked into the blower chamber 31 through the opening portions 62.

As shown in FIG. 4B, when the vibrating plate 41 bends towards the blower chamber 31, the top plate portion 18 also bends towards the piezoelectric element 42, so that the volume of the blower chamber 31 is reduced. At this time, since the pressure at the central portion of the blower chamber 31 is increased and the valve 80 opens, air in the blower chamber 31 is discharged from the vent hole 24.

As described above, in the piezoelectric blower 100, since the top plate portion 18 vibrates as the vibrating plate 41 vibrates, it is possible to essentially increase the vibration amplitude. Therefore, the piezoelectric blower 100 according to the embodiment can further increase discharge pressure and discharge flow rate.

As shown in FIGS. 4A and 4B and the dotted line in FIG. 5, each point on the vibrating plate 41 from the central axis C of the blower chamber 31 to the outer periphery of the blower chamber 31 is displaced by vibration. As shown by the solid line in FIG. 5, from the central axis C of the blower chamber 31 to the outer periphery of the blower chamber 31, the pressure at each point at the blower chamber 31 due to the vibrating plate 41 being vibrated.

As shown by the dotted line and the solid line in FIG. 5, in the range from the central axis C of the blower chamber 31 to the outer periphery of the blower chamber 31, the number of zero crossover points of the vibration displacement of the vibrating plate 41 is zero, and the number of zero crossover points of the pressure change at the blower chamber 31 is also zero. Therefore, the number of zero crossover points of the vibration displacement of the vibrating plate 41 is equal to the number of zero crossover points of the pressure change at the blower chamber 31.

Therefore, in the piezoelectric blower 100, when the vibrating plate 41 vibrates, a distribution of the displacements of the respective points on the vibrating plate 41 becomes a distribution that is close to the distribution of the pressure changes at the respective points at the blower chamber 31.

Here, when $af=(k_0c)/(2\pi)$, a node F of vibration of the vibrating plate 41 coincides with a node of pressure vibration of the blower chamber 31, and pressure resonance occurs. Further, even when the relationship of $0.8\times(k_0c)/(2\pi)\leq af\leq 1.2\times(k_0c)/(2\pi)$ is satisfied, the node F of the vibration of the vibrating plate 41 substantially coincides with the node of pressure vibration of the blower chamber 31.

The piezoelectric blower 100 is used for sucking a liquid having high viscosity, such as nasal mucus or phlegm. In order to prevent breakage of the piezoelectric element resulting from driving the piezoelectric element for a long time, the vibration speed of the piezoelectric element needs to be less than or equal to 2 m/s. In order to suck nasal mucus or phlegm, a pressure of 20 kPa or greater is required. Therefore, the pressure blower 100 requires a pressure amplitude of 10 kPa/(m/s) or greater. As shown in FIG. 6, the pressure amplitude becomes a maximum when af is 130 m/s. At 117 m/s and 143 m/s that deviate by ±10% from 130 m/s, a pressure amplitude of 20 kPa/(m/s) or greater can be obtained. Even at 104 m/s and 156 m/s that deviate by ±20% from 130 m/s, a pressure amplitude of 10 kPa/(m/s) or greater can be obtained.

Therefore, when the relationship of $0.8\times(k_0c)/(2\pi) \leq af \leq 1.2\times(k_0c)/(2\pi)$ is satisfied, the piezoelectric blower 100 can be used to suck a liquid having high viscosity, such as nasal mucus or phlegm, and can realize high discharge pressure and high discharge flow rate.

Further, when the relationship of $0.9\times(k_0c)/(2\pi) \leq af \leq 1.1\times(k_0c)/(2\pi)$ is satisfied, the piezoelectric blower 100 can realize very high discharge pressure and very high discharge flow rate.

In the piezoelectric blower 100, since the outer periphery of the blower chamber 31 becomes the node of pressure vibration of the blower chamber 31, the pressure at the outer periphery of the blower chamber 31 is atmospheric pressure at all times. Therefore, even if the outer periphery of the blower chamber 31 communicates with the outside of the blower chamber 31 through the opening portions 62 that are larger than a first vent hole 24 in Patent Document 1, the piezoelectric blower 100 can prevent a reduction in discharge pressure and discharge flow rate.

Consequently, the piezoelectric blower 100 can prevent a reduction in discharge pressure and discharge flow rate even if the large opening portions 62 are provided for ensuring sufficient flow rate.

Thus, the piezoelectric blower 100 can prevent the large opening portions 62 from becoming clogged with, for example, dust. That is, the piezoelectric blower 100 can prevent a reduction in discharge pressure and discharge flow rate caused by, for example, dust.

The piezoelectric blower 100 can prevent air from flowing into the blower chamber 31 from the outside of the blower chamber 31 through the vent hole 24 by using the valve 80. Therefore, the piezoelectric blower 100 can realize high discharge pressure and high discharge flow rate.

In the piezoelectric blower 100, when the vibrating plate 41 vibrates, the distribution of the displacements of the respective points on the vibrating plate 41 becomes a distribution that is close to the distribution of the pressure changes at the respective points at the blower chamber 31. That is, when the vibrating plate 41 vibrates, the points on the vibrating plate 41 are displaced in accordance with the pressure changes at the respective points at the blower chamber 31.

Therefore, the piezoelectric blower 100 is capable of transmitting vibration energy of the vibrating plate 41 to air in the blower chamber 31 almost without loss of the vibration energy of the vibrating plate 41. Consequently, the piezoelectric blower 100 can realize high discharge pressure and high discharge flow rate.

«Second Embodiment of the Present Disclosure»

A piezoelectric blower 200 according to a second embodiment of the present disclosure is described below.

FIG. 7 is a plan view of the piezoelectric blower 200 according to the second embodiment of the present disclosure. FIG. 8 is a back view of the piezoelectric blower 200 shown in FIG. 7. FIG. 9 is a sectional view taken along line T-T of the piezoelectric blower 200 shown in FIG. 7.

The piezoelectric blower 200 includes a valve 280, a housing 217, a vibrating plate 241, and a piezoelectric element 42 in that order from the top, and has a structure in which these components are successively placed upon each other.

In this embodiment, the piezoelectric element 42 corresponds to a "driving member" according to the present disclosure.

The vibrating plate 241 is disc-shaped, and is made of, for example, stainless steel (SUS). The thickness of the vibrating plate 241 is, for example, 0.5 mm. The vibrating plate 241 includes a first principal surface 240A and a second principal surface 240B.

The second principal surface 240B of the vibrating plate 241 is joined to ends of the housing 217. By this, the vibrating plate 241 forms, together with the housing 217, a column-shaped blower chamber 231 such that the blower chamber 231 is interposed therebetween in a thickness direction of the vibrating plate 241. The vibrating plate 241 and the housing 217 are formed such that the blower chamber 231 has a radius a. For example, in the embodiment, the radius a of the blower chamber 231 is 11 mm.

The vibrating plate 241 includes a vibrating portion 263, a frame portion 261 that surrounds the vibrating portion 263 and that is joined to the housing 217, and three connecting portions 262 that connect the vibrating portion 263 and the frame portion 261 to each other and that elastically support the vibrating portion 263 with respect to the frame portion 261.

The vibrating portion 263 forms, together with the housing 217, the blower chamber 231 such that the blower chamber 231 is interposed therebetween in the thickness direction of the vibrating plate 241. One of principal surfaces in a region of the vibrating portion 263 opposing a top plate portion 218 forms a bottom surface of the blower chamber 231. The vibrating plate 241 is formed by, for example, punching a metallic plate.

In the piezoelectric blower 200, the vibrating portion 263 is flexibly elastically supported with respect to the frame portion 261 by the three connecting portions 262, so that bending vibration of the vibrating portion 263 is hardly prevented.

The piezoelectric element 42 is disc-shaped, and is made of, for example, a lead zirconate titanate ceramic. Electrodes are formed on both principal surfaces of the piezoelectric element 42. The piezoelectric element 42 is joined to the first principal surface 240A of the vibrating plate 241 that is disposed opposite to the blower chamber 231, and expands and contracts in accordance with an applied alternating voltage. A joined body including the piezoelectric element 42 and the vibrating plate 241 that are joined to each other forms a piezoelectric actuator 250.

The housing 217 has a C-shaped cross section having an open bottom. The ends of the housing 217 are joined to the frame portion 261 of the vibrating plate 241. The housing 217 is made of, for example, a metal.

The housing 217 includes a top plate portion 218 opposing the second principal surface 240B of the vibrating plate 241 and a ring-shaped side wall portion 219 that is connected to the top plate portion 218.

The top plate portion 218 is a disc-shaped rigid body. The top plate portion 218 forms a top surface of the blower chamber 231. The top plate portion 218 includes a thick top portion 229 and a thin top portion 228 that is positioned at an inner-peripheral side of the thick top portion 229. The thin top portion 228 of the top plate portion 218 includes a vent hole 224 that allows a central portion of the blower chamber 231 to communicate with the outside of the blower chamber 231. The thickness of the thick top portion 229 is, for example, 0.5 mm, and the thickness of the thin top portion 228 is, for example, 0.05 mm. The diameter of the vent hole 224 is, for example, 0.6 mm.

The central portion of the blower chamber 231 is a portion that overlaps the piezoelectric element 42 when the first principal surface 240A of the vibrating plate 241 is viewed from the front. The top plate portion 218 is provided with a valve 280 that prevents gas from flowing into the blower chamber 231 from the outside of the blower chamber 231 through the vent hole 224.

A cavity 225, which is a portion of the blower chamber 231 and which communicates with the vent hole 224, is formed in a vibrating-portion-263 side of the top plate portion 218. The cavity 225 is column-shaped. The diameter of the cavity 225 is, for example, 3.0 mm, and the thickness of the cavity 225 is, for example, 0.45 mm.

Further, the top plate portion 218 includes opening portions 214 that allow an outer periphery of the blower chamber 231 to communicate with the outside of the blower chamber 231. The opening portions 214 are formed in an opposing region of the housing 217 opposing a region of the vibrating plate 241 that is positioned between the frame portion 261 and an outermost node F2 among nodes of vibration of the vibrating plate 241. The opening portions 214 are formed along substantially the entire periphery of the top plate portion 218 so as to surround the blower chamber 231.

In the embodiment, the blower chamber 231 corresponds to a "first blower chamber" according to the present disclosure. The top plate portion 218 corresponds to a "first movable portion" according to the present disclosure. The vent hole 224 corresponds to a "first vent hole" according to the present disclosure. The valve 280 corresponds to a "first valve" according to the present disclosure.

The flow of air when the piezoelectric blower 200 operates is described below.

FIGS. 10A and 10B are sectional views taken along line T-T of the piezoelectric blower 200 shown in FIG. 7 when the piezoelectric blower 200 operates at a third-order mode frequency (triple of the fundamental). FIG. 10A illustrates a case in which the volume of the blower chamber 231 has been maximally increased, and FIG. 10B illustrates a case in which the volume of the blower chamber 231 has been maximally reduced. Here, the illustrated arrows denote the flow of air.

FIG. 11 shows the relationship between pressure change at each point at the blower chamber 231 from a central axis C of the blower chamber 231 to the outer periphery of the blower chamber 231 and displacement of each point on the vibrating plate 241 from the central axis C of the blower chamber 231 to the outer periphery of the blower chamber 231, at a moment when the piezoelectric blower 200 shown in FIG. 7 is set in the state shown in FIG. 10B. FIG. 11 is obtained by simulation.

Here, in FIG. 11, the pressure change at each point at the blower chamber 231 and the displacement of each point on the vibrating plate 241 are indicated by a value that has been standardized based on the displacement of the center of the vibrating plate 241 existing on the central axis C of the blower chamber 231.

FIG. 12 shows the relationship between radius a×resonance frequency f and pressure amplitude in the piezoelectric blower 200 shown in FIG. 7. FIG. 12 is a figure in which the pressure amplitude is obtained by varying radius a×resonance frequency f by simulation. The dotted lines in FIG. 12 indicate a maximum value, and a lower limit and an upper limit of a range satisfying the relationship of $0.8\times(k_0c)/(2\pi)\leq af\leq 1.2\times(k_0c)/(2\pi)$. The lower limit value is 240 m/s, the upper limit value is 360 m/s, and the maximum value is 300 m/s.

Similarly, the alternate long and short dashed lines in FIG. 12 indicate a lower limit and an upper limit of a range satisfying the relationship of $0.9\times(k_0c)/(2\pi)\leq af\leq 1.1\times(k_0c)/(2\pi)$. The lower limit value is 270 m/s, and the upper limit value is 330 m/s.

The pressure amplitude shown in FIG. 12 is standardized based on the vibration speed of a central portion of the piezoelectric element 42. Since the fracture limitation of the piezoelectric element 42 becomes the upper limit, the pressure amplitude when the vibration speed=1 m/s is graphed in the measurement shown in FIG. 6.

When, in the state shown in FIG. 9, an alternating drive voltage with the third-order mode resonance frequency (fundamental) is applied to the electrodes on the two principal surfaces of the piezoelectric element 42, the piezoelectric element 42 expands and contracts and causes the vibrating plate 241 to undergo concentric bending vibration at the third-order mode resonance frequency f. However, since the vibrating plate 241 is flexibly supported by the connecting portions 262, the bending vibration of the vibrating plate 241 is not be transmitted to the frame portion 261 and the top plate portion 218. Therefore, the top plate portion 218 does not undergo bending vibration.

By this, as shown in FIGS. 10A and 10B, the vibrating plate 241 is bent, as a result of which the volume of the blower chamber 231 changes periodically.

The radius a of the blower chamber 231 and the resonance frequency f of the vibrating plate 241 satisfy the relationship of $0.8\times(k_0c)/(2\pi)\leq af\leq 1.2\times(k_0c)/(2\pi)$, where the acoustic velocity of air that passes through the blower chamber 231 is c and a value that satisfies the relationship of the Bessel function of the first kind of $J_0(k_0)=0$ is $k_0$. In the embodiment, for example, the resonance frequency f is 29 kHz. $k_0$ is 5.52.

A pressure change distribution u(r) of the points at the blower chamber 231 is expressed by the formula $u(r)=J_0(k_0r/a)$, where the distance from the central axis C of the blower chamber 231 is r.

As shown in FIG. 10A, when the vibrating plate 241 bends towards the piezoelectric element 42, the volume of a central portion of the blower chamber 231 is increased, and the volume of an outer peripheral portion of the blower chamber 231 that is positioned closer to the outer periphery than the central portion is reduced. At this time, since the pressure at the central portion of the blower chamber 231 is reduced and the valve 280 is closed, air does not enter and exit.

Next, as shown in FIG. 10B, when the vibrating plate 241 bends towards the blower chamber 231, the volume of the central portion of the blower chamber 231 is reduced, and the volume of the outer peripheral portion of the blower chamber 231 is increased. At this time, since the pressure at the central portion of the blower chamber 231 is increased and the valve 280 opens, air in the blower chamber 231 is discharged from the vent hole 224.

Here, as shown in FIGS. 10A and 10B and the dotted line in FIG. 11, each point on the vibrating plate 241 from the central axis C of the blower chamber 231 to the outer periphery of the blower chamber 231 is displaced by vibration. As shown by the solid line in FIG. 11, from the central axis C of the blower chamber 231 to the outer periphery of the blower chamber 231, the pressure at each point at the blower chamber 231 due to the vibrating plate 241 being vibrated.

As shown by the dotted line and the solid line in FIG. 11, in the range from the central axis C of the blower chamber 231 to the outer periphery of the blower chamber 231, the number of zero crossover points of the vibration displacement of the vibrating plate 241 is one, and the number of zero crossover points of the pressure change in the blower chamber 231 is also one. Therefore, the number of zero crossover points of the vibration displacement of the vibrating plate 241 is equal to the number of zero crossover points of the pressure change in the blower chamber 231.

Therefore, in the piezoelectric blower 200, when the vibrating plate 241 vibrates, a distribution of the displacements of the respective points on the vibrating plate 241 becomes a distribution that is close to the distribution of the pressure changes at the respective points at the blower chamber 231.

Here, when $af=(k_0c)/(2\pi)$, an outermost node F among nodes of vibration of the vibrating plate 241 coincides with a node of pressure vibration of the blower chamber 231, and pressure resonance occurs. Further, even when the relationship of $0.8\times(k_0c)/(2\pi)\leq af\leq 1.2\times(k_0c)/(2\pi)$ is satisfied, the outermost node F among the nodes of vibration of the vibrating plate 241 substantially coincides with the node of pressure vibration of the blower chamber 231.

The piezoelectric blower 200 is used for sucking a liquid having high viscosity, such as nasal mucus or phlegm. In order to prevent breakage of the piezoelectric element resulting from driving the piezoelectric element for a long time, the vibration speed of the piezoelectric element needs to be less than or equal to 2 m/s. In order to suck nasal mucus or phlegm, a pressure of 20 kPa or greater is required. Therefore, the pressure blower 200 requires a pressure amplitude of 10 kPa/(m/s) or greater. As shown in FIG. 12, the pressure amplitude becomes a maximum when af is 300 m/s. At 270 m/s and 330 m/s that deviate by ±10% from 300 m/s, a pressure amplitude of 20 kPa/(m/s) or greater can be obtained. Even at 240 m/s and 360 m/s that deviate by ±20% from 300 m/s, a pressure amplitude of 10 kPa/(m/s) or greater can be obtained.

Therefore, when the relationship of $0.8\times(k_0c)/(2\pi)\leq af\leq 1.2\times(k_0c)/(2\pi)$ is satisfied, the piezoelectric blower 200 can be used to suck a liquid having high viscosity, such as nasal mucus or phlegm, and can realize high discharge pressure and high discharge flow rate.

Further, when the relationship of $0.9\times(k_0c)/(2\pi)\leq af\leq 1.1\times(k_0c)/(2\pi)$ is satisfied, the piezoelectric blower 200 can realize very high discharge pressure and very high discharge flow rate.

In the piezoelectric blower 200, since the outer periphery of the blower chamber 231 becomes the node of pressure vibration of the blower chamber 231, the pressure at the outer periphery of the blower chamber 231 is atmospheric pressure at all times. Therefore, even if the outer periphery of the blower chamber 231 communicates with the outside of the blower chamber 231 through the opening portions 214 that are larger than a first vent hole 224 in Patent Document 1, the piezoelectric blower 200 can prevent a reduction in discharge pressure and discharge flow rate.

Consequently, the piezoelectric blower 200 can prevent a reduction in discharge pressure and discharge flow rate even if the large opening portions 214 are provided for ensuring sufficient flow rate.

The piezoelectric blower 200 can prevent the large opening portions 214 from becoming clogged with, for example, dust. That is, the piezoelectric blower 200 can prevent a reduction in discharge pressure and discharge flow rate caused by, for example, dust.

The piezoelectric blower 200 can prevent air from flowing into the blower chamber 231 from the outside of the blower chamber 231 through the vent hole 224 by using the valve 280. Therefore, the piezoelectric blower 200 can realize high discharge pressure and high discharge flow rate.

In the piezoelectric blower 200, when the vibrating plate 241 vibrates, the distribution of the displacements of the respective points on the vibrating plate 241 becomes a distribution that is close to the distribution of the pressure changes at the respective points at the blower chamber 231. That is, when the vibrating plate 241 vibrates, the points on the vibrating plate 241 are displaced in accordance with the pressure changes at the respective points at the blower chamber 231.

Therefore, the piezoelectric blower 200 is capable of transmitting vibration energy of the vibrating plate 241 to air in the blower chamber 231 almost without loss of the vibration energy of the vibrating plate 241. Consequently, the piezoelectric blower 200 can realize high discharge pressure and high discharge flow rate.

In the piezoelectric blower 200, the vibrating portion 263 is flexibly elastically supported with respect to the frame portion 261 by the three connecting portions 262, so that bending vibration of the vibrating portion 263 is hardly prevented. Therefore, in the piezoelectric blower 200, loss resulting from the bending vibration of the vibrating portion 263 is reduced.

However, since the vibrating portion 263 is flexibly elastically supported with respect to the frame portion 261 by the plurality of connecting portions 262, a frame-portion-261-side end 264 of the vibrating portion 263 also vibrates freely (refer to FIGS. 10A and 10B).

In the piezoelectric blower 200, since the opening portions 214 are formed in the aforementioned opposing region, the outermost node F2 among the nodes of vibration of the vibrating plate 241 defines the outer periphery of the blower chamber 231. That is, the radius a from the central axis C of the blower chamber 231 to the outer periphery of the blower chamber 231 is determined by the opening portions 214.

Therefore, the blower 200 having this structure can prevent a reduction in discharge pressure and discharge flow rate even if the vibrating plate 241 includes the vibrating portion 263, the frame portion 261, and the connecting portions 262.

Consequently, the piezoelectric blower 200 according to the second embodiment provides the same advantages as the piezoelectric blower 100 according to the first embodiment.

«Third Embodiment of the Present Disclosure»

A piezoelectric blower 300 according to a third embodiment of the present disclosure is described below.

FIG. 13 is an external perspective view of the piezoelectric blower 300 according to the third embodiment of the present disclosure. FIG. 14 is an external perspective view of the piezoelectric blower 300 shown in FIG. 13. FIG. 15 is a sectional view taken along line U-U of the piezoelectric blower 300 shown in FIG. 13.

The piezoelectric blower 300 differs from the piezoelectric blower 100 in that the piezoelectric blower 300 does not include the valve 80 and includes a housing 317. The piezoelectric blower 300 includes a housing 17, a vibrating plate 41, a piezoelectric element 42, and the housing 317 in that order from the top, and has a structure in which these components are successively placed upon each other. Since the other structural features are the same as those of the piezoelectric blower 100, these are not described below.

The housing 317 has a C-shaped cross section having an open top. Ends of the housing 317 are joined to a first principal surface 40A of the vibrating plate 41. The housing 317 is made of, for example, a metal.

By this, the housing 317 forms, together with an actuator 50, a column-shaped blower chamber 331 such that the blower chamber 331 is interposed therebetween in a thickness direction of the vibrating plate 41. The vibrating plate 41 and the housing 317 are formed such that the blower chamber 331 has a radius a. That is, the radius of the blower chamber 331 is a, which is the same as the radius a of the blower chamber 31.

Opening portions 62 in the vibrating plate 41 in the embodiment allow an outer periphery of the blower chamber 31 to communicate with an outer periphery of the blower chamber 331. The opening portions 62 are formed along substantially the entire periphery of the vibrating plate 41 so as to surround the blower chamber 331. Therefore, a region that exists inwardly from the opening portions 62 in a vent-hole-324-side surface of the actuator 50 (more precisely, a vent-hole-324-side principal surface of a vibrating portion 36 that exists inwardly from a ring that is formed by connecting all of the opening portions 62) forms a bottom surface of the blower chamber 331.

The housing 317 includes a disc-shaped top plate portion 318 opposing the first principal surface 40A of the vibrating plate 41 and a ring-shaped side wall portion 319 that is connected to the top plate portion 318. A portion of the top plate portion 318 forms a top surface of the blower chamber 331.

In the embodiment, the housing 17 and the housing 317 constitute a "housing" according to the present disclosure. The blower chamber 31 corresponds to a "first blower chamber" according to the present disclosure, and the blower chamber 331 corresponds to a "second blower chamber" according to the present disclosure. A top plate portion 18 corresponds to a "first movable portion" according to the present disclosure, and the top plate portion 318 corresponds to a "second movable portion" according to the present disclosure.

The top plate portion 318 includes a column-shaped vent hole 324 that allows a central portion of the blower chamber 331 to communicate with the outside of the housing 317. The central portion of the blower chamber 331 is a portion that overlaps the piezoelectric element 42 when the first principal surface 40A of the vibrating plate 41 is viewed from the front. The diameter of the vent hole 324 is, for example, 0.6 mm.

In the embodiment, the vent hole 324 corresponds to a "second vent hole" according to the present disclosure.

The flow of air when the piezoelectric blower 300 operates is described below.

FIGS. 16A and 16B are sectional views taken along line U-U of the piezoelectric blower 300 shown in FIG. 13 when the piezoelectric blower 300 operates at a first-order mode frequency (fundamental). FIG. 16A illustrates a case in which the volume of the blower chamber 31 has been maximally increased and the volume of the blower chamber 331 has been maximally reduced, and FIG. 16B illustrates a case in which the volume of the blower chamber 31 has been maximally reduced and the volume of the blower chamber 331 has been maximally increased. Here, the illustrated arrows denote the flow of air.

Pressure change at each point at the blower chamber 31 from a central axis C of the blower chamber 31 to the outer periphery of the blower chamber 31 at a moment when the piezoelectric blower 300 shown in FIG. 13 is set in the state shown in FIG. 16B is substantially equal to the pressure change at each point at the blower chamber 31 from the central axis C of the blower chamber 31 to the outer periphery of the blower chamber 31 at the moment when the piezoelectric blower 100 shown in FIG. 1 is set in the state shown in FIG. 4B (see FIG. 5).

Pressure change at each point at the blower chamber 331 from a central axis C of the blower chamber 331 to the outer periphery of the blower chamber 331 at a moment when the piezoelectric blower 300 shown in FIG. 13 is set in the state shown in FIG. 16A is substantially equal to the pressure change at each point at the blower chamber 31 from the central axis C of the blower chamber 31 to the outer periphery of the blower chamber 31 (refer to FIG. 5) at the moment when the piezoelectric blower 100 shown in FIG. 1 is set in the state shown in FIG. 4B. That is, a pressure change distribution u(r) of the points at the blower chamber 331 from the central axis C of the blower chamber 331 to the outer periphery of the blower chamber 331 at the moment when the piezoelectric blower 300 shown in FIG. 13 is set in the state shown in FIG. 16A is indicated by the solid line in FIG. 5.

The relationship between radius a×resonance frequency f and pressure amplitude in the blower chamber 331 of the piezoelectric blower 300 is substantially the same as the relationship between radius a×resonance frequency f and pressure amplitude in the piezoelectric blower 31. That is, the relationship between radius a×resonance frequency f and pressure amplitude in the blower chamber 331 of the piezoelectric blower 300 is illustrated in FIG. 6.

When, in the state shown in FIG. 15, an alternating drive voltage with the first-order mode frequency (fundamental) is applied to electrodes on two principal surfaces of the piezoelectric element 42, the piezoelectric element 42 expands and contracts and causes the vibrating plate 41 to undergo concentric bending vibration at the first-order mode resonance frequency f.

At the same time, due to pressure variations in the blower chamber 31 resulting from the bending vibration of the vibrating plate 41, the top plate portion 18 undergoes concentric bending vibration in the first-order mode as the vibrating plate 41 undergoes the bending vibration (in this embodiment, such that the vibration phase lags by 180 degrees).

Due to pressure variations in the blower chamber 331 resulting from the bending vibration of the vibrating plate 41, the top plate portion 318 undergoes concentric bending vibration in the first-order mode as the vibrating plate 41 undergoes the bending vibration (in this embodiment, such that the vibration phase lags by 180 degrees).

By this, as shown in FIGS. 16A and 16B, the volumes of the blower chambers 31 and 331 change periodically.

The radius a of the blower chamber 31 and the resonance frequency f of the vibrating plate 41 satisfy the relationship of $0.8\times(k_0c)/(2\pi)\leq af\leq 1.2\times(k_0c)/(2\pi)$, where the acoustic velocity of air that passes through the blower chamber 31 is c and a value that satisfies the relationship of the Bessel function of the first kind of $J_0(k_0)=0$ is $k_0$. Further, the radius a of the blower chamber 331 and the resonance frequency f of the vibrating plate 41 also satisfy the relationship of $0.8\times(k_0c)/(2\pi)\leq af\leq 1.2\times(k_0c)/(2\pi)$. In the embodiment, for example, the resonance frequency f is 21 kHz. The acoustic velocity c of air is 340 m/s. $k_0$ is 2.40.

A pressure change distribution u(r) of the points at the blower chamber 31 is expressed by the formula $u(r)=J_0(k_0r/a)$, where the distance from the central axis C of the blower chamber 31 is r. The pressure change distribution u(r) of the points at the blower chamber 331 is also expressed by the formula $u(r)=J_0(k_0r/a)$.

As shown in FIG. 16A, when the vibrating plate 41 bends towards the piezoelectric element 42, the top plate portion 18 bends towards a side opposite to the piezoelectric element 42, so that the volume of the blower chamber 31 is increased. Further, the top plate portion 318 bends towards the piezoelectric element 42, so that the volume of the blower chamber 331 is reduced.

At this time, since the pressure at a central portion of the blower chamber 31 is reduced, air that exists outside of the housing 17 is sucked into the blower chamber 31 through a vent hole 24, and air in the blower chamber 331 is sucked into the blower chamber 31 through the opening portions 62. At this time, since the pressure at a central portion of the blower chamber 331 is increased, air in the central portion of the blower chamber 331 is discharged to the outside of the housing 317 through the vent hole 324.

As shown in FIG. 16B, when the vibrating plate 41 bends towards the blower chamber 31, the top plate portion 18 bends towards the piezoelectric element 42, so that the volume of the blower chamber 31 is reduced. Further, the top plate portion 318 bends towards the side opposite to the piezoelectric element 42, and the volume of the blower chamber 331 is increased.

At this time, since the pressure at the central portion of the blower chamber 31 is increased, air in the central portion of the blower chamber 31 is discharged to the outside of the housing 17 through the vent hole 24. In addition, at this time, since the pressure at the central portion of the blower chamber 331 is reduced, air that exists outside of the housing 317 is sucked into the blower chamber 331 through the vent hole 324, and air in the blower chamber 31 is sucked into the blower chamber 331 through the opening portions 62.

As described above, when the actuator 50 is driven, the piezoelectric blower 300 allows the air in the blower chamber 31 to be discharged to the outside of the housing 17 through the vent hole 24, and the air in the blower chamber 331 to be discharged to the outside of the housing 17 through the vent hole 324.

In the piezoelectric blower 300, since the top plate portions 18 and 318 vibrate as the vibrating plate 41 vibrates, it is possible to essentially increase vibration amplitude. Therefore, the piezoelectric blower 300 according to the embodiment can further increase discharge pressure and discharge flow rate.

As shown in FIGS. 16A and 16B and the dotted lines in FIG. 5, each point on the vibrating plate 41 from the central axes C of the blower chambers 31 and 331 to the outer peripheries of the blower chambers 31 and 331 is displaced by vibration. As shown by the solid line in FIG. 5, from the central axis C of the blower chamber 31 to the outer periphery of the blower chamber 31, the pressure at each point at the blower chamber 31 due to the vibrating plate 41 being vibrated. From the central axis C of the blower chamber 331 to the outer periphery of the blower chamber 331, the pressure at each point at the blower chamber 331 also changes due to the vibrating plate 41 being vibrated.

As shown by the dotted line and the solid line in FIG. 5, in the range from the central axis C of the blower chamber 31 to the outer periphery of the blower chamber 31, the number of zero crossover points of the vibration displacement of the vibrating plate 41 is zero, the number of zero crossover points of the pressure change at the blower chamber 31 is also zero, and the number of zero crossover points of the pressure change at the blower chamber 331 is also zero.

Therefore, the number of zero crossover points of the vibration displacement of the vibrating plate 41 is equal to the number of zero crossover points of the pressure change at the blower chamber 31 and to the number of zero crossover points of the pressure change at the blower chamber 331.

Therefore, in the piezoelectric blower 300, when the vibrating plate 41 vibrates, a distribution of the displacements of the respective points on the vibrating plate 41 becomes a distribution that is close to the distribution of the pressure changes at the respective points at the blower chamber 31 and to the distribution of the pressure changes at the respective points at the blower chamber 331.

Here, as shown in FIGS. 16A and 16B, when the volume of the blower chamber 331 is reduced, the volume of the blower chamber 31 is increased, whereas, when the volume of the blower chamber 31 is reduced, the volume of the blower chamber 331 is increased. That is, the volume of the blower chamber 31 and the volume of the blower chamber 331 change in an opposite manner.

Therefore, when the actuator 50 is driven, air at the outer periphery of the blower chamber 31 and air at the outer periphery of the blower chamber 331 move through the opening portions 62. Consequently, when the actuator 50 is driven, the pressure at the outer periphery of the blower chamber 31 and the pressure at the outer periphery of the blower chamber 331 cancel out through the opening portions 62, and are atmospheric pressure (node) at all times.

Here, when $af=(k_0c)/(2\pi)$, a node F of vibration of the vibrating plate 41 coincides with a node of pressure vibration of the blower chamber 31 and a node of pressure vibration of the blower chamber 331, and pressure resonance occurs. Further, even when the relationship of $0.8\times(k_0c)/(2\pi)\leq af\leq 1.2\times(k_0c)/(2\pi)$ is satisfied, the node F of vibration of the vibrating plate 41 substantially coincides with the node of pressure vibration of the blower chamber 31 and the node of pressure vibration of the blower chamber 331.

Therefore, when the radius a of the blower chamber 31 and the resonance frequency f of the vibrating plate 41 satisfy the relationship of $0.8\times(k_0c)/(2\pi)\leq af\leq 1.2\times(k_0c)/(2\pi)$, and when the radius a of the blower chamber 331 and the resonance frequency f of the vibrating plate 41 satisfy the relationship of $0.8\times(k_0c)/(2\pi)\leq af\leq 1.2\times(k_0c)/(2\pi)$, the piezoelectric blower 300 can realize high discharge pressure and high discharge flow rate through both the vent hole 24 and the vent hole 324.

Therefore, the piezoelectric blower 300 can realize a discharge flow rate that is substantially twice the discharge flow rate of the piezoelectric blower 100 that performs discharge from one vent hole 24, without increasing power consumption. Further, when the radius a of the blower chamber 31 and the resonance frequency f of the vibrating plate 41 satisfy the relationship of $0.9\times(k_0c)/(2\pi)\leq af\leq 1.1\times(k_0c)/(2\pi)$, and when the radius a of the blower chamber 331 and the resonance frequency f of the vibrating plate 41 satisfy the relationship of $0.9\times(k_0c)/(2\pi)\leq af\leq 1.1\times(k_0c)/(2\pi)$, the piezoelectric blower 300 can realize very high discharge pressure and very high discharge flow rate.

The piezoelectric blower 300 is capable of intercepting ultrasonic waves emitted from the piezoelectric element 42 by using the housing 317.

In the piezoelectric blower 100, if an obstacle (such as a flat board) is placed near the openings 62 when the actuator 50 is driven, the pressure at the outer periphery of the blower chamber 31 does not become atmospheric pressure, as a result of which discharge pressure and discharge flow rate are reduced.

In contrast, in the piezoelectric blower 300, the opening portions 62 are protected by the housing 317. Therefore, in the piezoelectric blower 300, even if an obstacle is placed near the opening portions 62 when the actuator 50 is driven, the pressure at the outer periphery of the blower chamber 31 and the pressure at the outer periphery of the blower chamber 331 can be maintained at atmospheric pressure at all times through the opening portions 62 when the actuator 50 is driven. Consequently, the piezoelectric blower 300 can prevent a reduction in discharge pressure and discharge flow rate.

In the piezoelectric blower 300, when the vibrating plate 41 vibrates, the distribution of the displacements of the respective points on the vibrating plate 41 becomes a distribution that is close to the distribution of the pressure changes at the respective points at the blower chamber 31 and to the distribution of the pressure changes at the respective points at the blower chamber 331. That is, when the vibrating plate 41 vibrates, the points on the vibrating plate 41 are displaced in accordance with the pressure changes at the respective points at the blower chamber 31 and the pressure changes at the respective points at the blower chamber 331.

Therefore, the piezoelectric blower 300 is capable of transmitting vibration energy of the vibrating plate 41 to air in the blower chambers 31 and 331 almost without loss of the vibration energy of the vibrating plate 41. Therefore, the piezoelectric blower 300 can realize high discharge pressure and high discharge flow rate.

«Fourth Embodiment of the Present Disclosure»

A piezoelectric blower 400 according to a fourth embodiment of the present disclosure is described below.

FIG. 17 is an external perspective view of the piezoelectric blower 400 according to the fourth embodiment of the present disclosure.

The piezoelectric blower 400 differs from the piezoelectric blower 300 in that the piezoelectric blower 400 includes a housing 417 including a vent hole 424 and a valve 80, and a housing 427 including a vent hole 425 and a valve 480. Since the other structural features are the same as those of the piezoelectric blower 300, these are not described below.

The housing 417 differs from the housing 17 shown in FIG. 15 in that the housing 417 includes a top plate portion 418 including the vent hole 424 in a portion thereof opposing opening portions 62 and a valve 80 is provided at a vent hole 24. Since the other structural features of the housing 417 are the same as those of the housing 17 shown in FIG. 15, these are not described below.

The housing 427 differs from the housing 317 shown in FIG. 15 in that the housing 427 includes a top plate portion 428 including the vent hole 425 in a portion thereof opposing the opening portions 62 and a valve 480 is provided at a vent hole 324. Since the other structural features of the housing 427 are the same as those of the housing 317 shown in FIG. 15, these are not described below.

In the embodiment, the vent holes 424 and 425 each correspond to a "third vent hole" according to the present disclosure. The valve 80 corresponds to a "first valve" according to the present disclosure, and the valve 480 corresponds to a "second valve" according to the present disclosure.

The flow of air when the piezoelectric blower 400 operates is described below.

FIGS. 18A and 18B are sectional views of the piezoelectric blower 400 shown in FIG. 17 when the piezoelectric blower 400 operates at a first-order mode frequency (fundamental). FIG. 18A illustrates a case in which the volume of a blower chamber 31 has been maximally increased and the volume of a blower chamber 331 has been maximally reduced, and FIG. 18B illustrates a case in which the volume of the blower chamber 31 has been maximally reduced and the volume of the blower chamber 331 has been maximally increased. Here, the illustrated arrows denote the flow of air.

When, in the state shown in FIG. 17, an alternating drive voltage with the first-order mode frequency (fundamental) is applied to electrodes on two principal surfaces of a piezoelectric element 42, the piezoelectric element 42 expands and contracts and causes a vibrating plate 41 to undergo concentric bending vibration at the first-order mode resonance frequency f.

At the same time, due pressure variations in the blower chamber 31 resulting from the bending vibration of the vibrating plate 41, the top plate portion 418 undergoes concentric bending vibration in the first-order mode as the vibrating plate 41 undergoes the bending vibration (in this embodiment, such that the vibration phase lags by 180 degrees).

Due to pressure variations in the blower chamber 331 resulting from the bending vibration of the vibrating plate 41, the top plate portion 428 undergoes concentric bending vibration in the first-order mode as the vibrating plate 41 undergoes the bending vibration (in this embodiment, such that the vibration phase lags by 180 degrees).

By this, as shown in FIGS. 18A and 18B, the volumes of the blower chambers 31 and 331 change periodically.

Even in the embodiment, a radius a of the blower chamber 31 and the resonance frequency f of the vibrating plate 41 satisfy the relationship of $0.8\times(k_0c)/(2\pi)\leq af\leq 1.2\times(k_0c)/(2\pi)$. Further, a radius a of the blower chamber 331 and the resonance frequency f of the vibrating plate 41 satisfy the relationship of $0.8\times(k_0c)/(2\pi)\leq af\leq 1.2\times(k_0c)/(2\pi)$. For example, even in the embodiment, the resonance frequency f is 21 kHz. The acoustic velocity c of air is 340 m/s. $k_0$ is 2.40.

A pressure change distribution u(r) of points at the blower chamber 31 is expressed by the formula $u(r)=J_0(k_0r/a)$, where the distance from a central axis C of the blower chamber 31 is r. A pressure change distribution u(r) of points at the blower chamber 331 is also expressed by the formula $u(r)=J_0(k_0r/a)$.

As shown in FIG. 18A, when the vibrating plate 41 bends towards the piezoelectric element 42, the top plate portion 418 bends towards a side opposite to the piezoelectric element 42, so that the volume of the blower chamber 31 is increased. Further, the top plate portion 428 bends towards the piezoelectric element 42, so that the volume of the blower chamber 331 is reduced.

At this time, since the pressure at a central portion of the blower chamber 31 is reduced, the valve 80 is closed, and air that exists outside of the piezoelectric blower 400 and air in the blower chamber 331 are sucked into the blower chamber 31 through the opening portions 62. At this time, since the pressure at a central portion of the blower chamber 331 is increased, the valve 480 opens, and air in the central portion of the blower chamber 331 is discharged to the outside of the housing 427 through the vent hole 324.

As shown in FIG. 18B, when the vibrating plate 41 bends towards the blower chamber 31, the top plate portion 418 bends towards the piezoelectric element 42, so that the volume of the blower chamber 31 is reduced. Further, the top plate portion 428 bends towards the side opposite to the piezoelectric element 42, and the volume of the blower chamber 331 is increased.

At this time, since the pressure at the central portion of the blower chamber 31 is increased, the valve 80 opens, and air in the central portion of the blower chamber 31 is discharged to the outside of the housing 417 through the vent hole 24.

In addition, at this time, since the pressure at the central portion of the blower chamber 331 is reduced, the valve 480 is closed, and air that exists outside of the piezoelectric blower 400 and air in the blower chamber 31 are sucked into the blower chamber 331 through the opening portions 62.

As described above, when an actuator 50 is driven, the piezoelectric blower 400 allows the air in the blower chamber 31 to be discharged to the outside of the housing 417 through the vent hole 24, and the air in the blower chamber 331 to be discharged to the outside of the housing 427 through the vent hole 324.

In the piezoelectric blower 400, since the top plate portions 418 and 428 vibrate as the vibrating plate 41 vibrates, it is possible to essentially increase vibration amplitude. Therefore, the piezoelectric blower 400 according to the embodiment can further increase discharge pressure and discharge flow rate.

Here, as shown in FIGS. 18A and 18B, when the volume of the blower chamber 331 is reduced, the volume of the blower chamber 31 is increased, whereas, when the volume of the blower chamber 31 is reduced, the volume of the blower chamber 331 is increased. That is, the volume of the blower chamber 31 and the change of the blower chamber 331 are opposite change in an opposite manner.

Therefore, when the actuator 50 is driven, air at the outer periphery of the blower chamber 31 and air at the outer periphery of the blower chamber 331 move through the opening portions 62. Consequently, when the actuator 50 is driven, the pressure at the outer periphery of the blower chamber 31 and the pressure at the outer periphery of the blower chamber 331 cancel out through the opening portions 62, and are atmospheric pressure (node) at all times.

Here, when $af=(k_0c)/(2\pi)$, a node F of vibration of the vibrating plate 41 coincides with a node of pressure vibration of the blower chamber 31 and a node of pressure vibration of the blower chamber 331, and pressure resonance occurs. Further, even when the relationship of $0.8\times(k_0c)/(2\pi)\leq af\leq 1.2\times(k_0c)/(2\pi)$ is satisfied, the node F of vibration of the vibrating plate 41 substantially coincides with the node of pressure vibration of the blower chamber 31 and the node of pressure vibration of the blower chamber 331.

Therefore, when the radius a of the blower chamber 31 and the resonance frequency f of the vibrating plate 41 satisfy the relationship of $0.8\times(k_0c)/(2\pi)\leq af\leq 1.2\times(k_0c)/(2\pi)$, and when the radius a of the blower chamber 331 and the resonance frequency f of the vibrating plate 41 satisfy the relationship of $0.8\times(k_0c)/(2\pi)\leq af\leq 1.2\times(k_0c)/(2\pi)$, the piezoelectric blower 400 can realize high discharge pressure and high discharge flow rate through both the vent hole 24 and the vent hole 324.

Therefore, the piezoelectric blower 400 can realize a discharge flow rate that is substantially twice the discharge flow rate of the piezoelectric blower 100 that performs discharge from one vent hole 24, without increasing power consumption.

Further, when the radius a of the blower chamber 31 and the resonance frequency f of the vibrating plate 41 satisfy the relationship of $0.9\times(k_0c)/(2\pi)\leq af\leq 1.1\times(k_0c)/(2\pi)$, and when the radius a of the blower chamber 331 and the resonance frequency f of the vibrating plate 41 satisfy the relationship of $0.9\times(k_0c)/(2\pi)\leq af\leq 1.1\times(k_0c)/(2\pi)$, the piezoelectric blower 400 can realize very high discharge pressure and very high discharge flow rate.

The piezoelectric blower 400 is capable of intercepting ultrasonic waves emitted from the piezoelectric element 42 by using the housing 427.

Even in the piezoelectric blower 400, the opening portions 62 are protected by the housing 427. Therefore, in the piezoelectric blower 400, even if an obstacle is placed near the opening portions 62 when the actuator 50 is driven, the pressure at the outer periphery of the blower chamber 31 and the pressure at the outer periphery of the blower chamber 331 can be maintained at atmospheric pressure at all times through the opening portions 62 when the actuator 50 is driven. Consequently, even the piezoelectric blower 400 can prevent a reduction in discharge pressure and discharge flow rate.

The piezoelectric blower 400 includes the valve 80, the valve 480, the vent hole 424, and the vent hole 425. Therefore, as shown in FIGS. 18A and 18B, air is not sucked into the blower chambers 31 and 331 from the outside of the piezoelectric blower 400 through the vent holes 24 and 324. That is, unlike the piezoelectric blower 300 shown in FIGS. 16A and 16B, the piezoelectric blower 400 does not cause air current to flow in opposite directions through the vent holes 24 and 324. Therefore, in the piezoelectric blower 400, the air can flow in one direction.

In the piezoelectric blower 400, as shown in FIGS. 18A and 18B and FIG. 5, when the vibrating plate 41 vibrates, a distribution of displacements of the respective points on the vibrating plate 41 becomes a distribution that is close to the distribution of the pressure changes at the respective points at the blower chamber 31 and to the distribution of the pressure changes at the respective points at the blower chamber 331. That is, when the vibrating plate 41 vibrates, the points on the vibrating plate 41 are displaced in accordance with the pressure changes at the respective points at the blower chamber 31 and the pressure changes at the respective points at the blower chamber 331.

Therefore, the piezoelectric blower 400 is capable of transmitting vibration energy of the vibrating plate 41 to the air in the blower chambers 31 and 331 almost without loss of the vibration energy of the vibrating plate 41. Consequently, the blower 400 can realize high discharge pressure and high discharge flow rate.

«Other Embodiments»

Although, in the above-described embodiments, air is used as the fluid, the present disclosure is not limited thereto. Fluids other than air may be used.

Although, in the above-described embodiments, the vibrating plates 41 and 241 are made of SUS, the present disclosure is not limited thereto. The vibrating plates 41 and 241 may be made of other materials, such as aluminum, titanium, magnesium, or copper.

Although, in the above-described embodiments, the piezoelectric element 42 is provided as the driving source of the blower, the present disclosure is not limited thereto. For example, the piezoelectric element 42 may be formed as a blower that performs pumping by electromagnetic driving.

Although, in the above-described embodiments, the piezoelectric element 42 is made of a lead zirconate titanate ceramic, the present disclosure is not limited thereto. For example, the piezoelectric element 42 may be made of piezoelectric materials of a non-lead piezoelectric ceramic such as a potassium sodium niobate-based ceramic or an alkali niobate-based ceramic.

Although, in the above-described embodiments, a unimorph piezoelectric vibrator is used, the present disclosure is not limited thereto. A bimorph piezoelectric vibrator in which the piezoelectric element 42 is attached to each of two surfaces of the vibrating plate 41 may also be used.

Although, in the above-described embodiments, the disc-shaped piezoelectric element 42, the disc-shaped vibrating plate 41, and the disc-shaped top plate portions 18, 318, 418, and 428 are used, the present disclosure is not limited thereto. For example, they may have a rectangular or a polygonal shape.

Although, in the above-described embodiments, the top plate portions 18, 318, 418, and 428 undergo concentric bending vibration as the vibrating plate 41 undergoes bending vibration, the present disclosure is not limited thereto. Actually, only the vibrating plate 41 may undergo bending vibration, that is, the top plate portions 18, 318, 418, and 428 need not undergo bending vibration as the vibrating plate 41 undergoes bending vibration.

Although, in the above-described embodiments, $k_0$ is 2.40 or 5.52, the present disclosure is not limited thereto. $k_0$ may be any value that satisfies the relationship of $J_0(k_0)=0$, such as 8.65, 11.79, or 14.93.

Although, in the first embodiment, the piezoelectric element 42 is joined to the first principal surface 40A of the vibrating plate 41 at the side opposite to the blower chamber 31, the present disclosure is not limited thereto. Actually, for example, the piezoelectric element 42 may be joined to the second principal surface 40B of the vibrating plate 41 at a side of the blower chamber 31, or two piezoelectric elements 42 may be joined to the first and second principal surfaces 40A and 40B of the vibrating plate 41. In this case, the housing 17 forms, together with a piezoelectric actuator including at least one piezoelectric element 42 and the vibrating plate 41, a first blower chamber such that the first blower chamber is interposed therebetween in a thickness direction of the vibrating plate 41.

Similarly, although, in the second embodiment, the piezoelectric element 42 is joined to the first principal surface 240A of the vibrating plate 241 at the side opposite to the blower chamber 231, the present disclosure is not limited thereto. Actually, for example, the piezoelectric element 42 may be joined to the second principal surface 240B of the vibrating plate 241 at a side of the blower chamber 231, or two piezoelectric elements 42 may be joined to the first and second principal surfaces 240A and 240B of the vibrating plate 241. In this case, the housing 217 forms, together with a piezoelectric actuator including at least one piezoelectric element 42 and the vibrating plate 241, a first blower chamber such that the first blower chamber is interposed therebetween in the thickness direction of the vibrating plate 241.

Similarly, although, in the third and fourth embodiments, the piezoelectric element 42 is joined to the first principal surface 40A of the vibrating plate 41 at the side of the blower chamber 331, the present disclosure is not limited thereto. Actually, for example, the piezoelectric element 42 may be joined to the second principal surface 40B of the vibrating plate 41 at the side of the blower chamber 31, or two piezoelectric elements 42 may be joined to the first and second principal surfaces 40A and 40B of the vibrating plate 41. In this case, the housing 17 forms, together with a piezoelectric actuator including at least one piezoelectric element 42 and the vibrating plate 41, a first blower chamber such that the first blower chamber is interposed therebetween in the thickness direction of the vibrating plate 41, and the housing 317 forms, together with a piezoelectric actuator including at least one piezoelectric element 42 and the vibrating plate 41, a second blower chamber such that the second blower chamber is interposed therebetween in the thickness direction of the vibrating plate 41.

Although, in the above-described embodiments, the vibrating plate of the piezoelectric blower undergoes bending vibration at the first-order mode frequency or the third-order mode frequency, the present disclosure is not limited thereto. Actually, the vibrating plate may undergo bending vibration in a vibration mode of a third-order mode or a higher odd-order mode producing a plurality of vibration antinodes.

Although, in the above-described embodiments, the blower chambers 31, 231, and 331 are column-shaped, the present disclosure is not limited thereto. Actually, the blower chambers may have the shape of a regular prism. In this case, instead of using the radius a of the blower chamber, the shortest distance a from the central axis of the blower chamber to the outer periphery of the blower chamber is used.

Although, in the above-described embodiments, the top plate portion 18 of the housing 17 includes one circular vent hole 24, the top plate portion 218 of the housing 217 includes one circular vent hole 224, and the top plate portion 318 of the housing 317 includes one circular vent hole 324, the present disclosure is not limited thereto. Actually, for example, as shown in FIGS. 19 to 21, a plurality of vent holes 524, a plurality of vent holes 624, and a plurality of vent holes 724 may be provided; or, for example, as with the vent holes 624 and the vent holes 724 shown in FIGS. 20 and 21 and a vent hole 824 shown in FIG. 22, the vent hole or holes need not be circular.

Although, in the above-described embodiments, the valve 80 is provided at the vent hole 24, and the valve 280 is provided at the vent hole 224, the present disclosure is not limited thereto. Actually, the valve need not be provided. If the valve is not provided, when, as shown in FIGS. 4A and 10A, the vibrating plates 41 and 241 bend towards the piezoelectric element 42, air current in a direction opposite to that in FIGS. 4B and 10B is generated. Therefore, discharge flow and suction flow at a high wind speed alternately occur from the vent hole 24 and the vent hole 224. That is, a strong reciprocating current can be produced. Such a strong reciprocating current can be used for, for example, cooling heat-generating parts.

Although, in the above-described embodiments, the opening portions 62 are formed in the vibrating plate 41, and the opening portions 214 are formed in the top plate portion 218, the present disclosure is not limited thereto. Actually, the opening portions may be formed in the side wall portion of the housing.

Although, in the second embodiment, the opening portions 214 are formed in the region of the housing 217 opposing the region of the vibrating plate 241 that is positioned between the frame portion 261 and the outermost node F2 among the nodes of vibration of the vibrating plate 241 (see FIG. 9), the present disclosure is not limited thereto. Actually, the opening portions 214 may be formed in a region of the vibrating plate 241 that is positioned between the frame portion 261 and the outermost node F2 among the nodes of vibration of the vibrating plate 241.

Lastly, the description of the above-described embodiments is to be considered in all respects only as illustrative and not restrictive. The scope of the present disclosure is indicated by the claims rather than by the above-described embodiments. Further, the scope of the present disclosure embraces all changes which come within the meaning and range within the equivalency of the claims.

C central axis
F, F1, F2 node
17 housing
18 top plate portion
19 side wall portion
24 vent hole

31 blower chamber
34 outer peripheral portion
35 beam portion
36 vibrating portion
40A first principal surface
40B second principal surface
41 vibrating plate
42 piezoelectric element
50 piezoelectric actuator
62 opening portion
80 valve
100 piezoelectric blower
200 piezoelectric blower
214 opening portion
217 housing
218 top plate portion
219 side wall portion
224 vent hole
225 cavity
228 thin top portion
229 thick top portion
231 blower chamber
240A first principal surface
240B second principal surface
241 vibrating plate
250 piezoelectric actuator
261 frame portion
262 connecting portion
263 vibrating portion
264 end
280 valve
300 piezoelectric blower
317 housing
318 top plate portion
319 side wall portion
324 vent hole
331 blower chamber
400 piezoelectric blower
417 housing
418 top plate portion
424, 425 vent hole
427 housing
428 top plate portion
480 valve
517 housing
524 vent hole
617 housing
624 vent hole
717 housing
724 vent hole
817 housing
824 vent hole

The invention claimed is:

1. A blower comprising:

an actuator including a vibrating plate and a driving member, the vibrating plate including a first principal surface and a second principal surface, the driving member being provided on at least one of the first principal surface and the second principal surface of the vibrating plate, the driving member causing the vibrating plate to undergo a concentric bending vibration; and a housing defining, together with the actuator, a first blower chamber such that the first blower chamber is interposed therebetween in a thickness direction of the vibrating plate, the housing including a first vent hole allowing the first blower chamber to communicate with an outside of the first blower chamber, wherein at least one of the vibrating plate and the housing includes opening portions, and the opening portions are formed along a periphery of the vibrating plate so as to surround the first blower chamber and allow the first blower chamber to communicate with the outside of the first blower chamber, and wherein a shortest distance a from a central axis of the first blower chamber to the outer periphery of the first blower chamber and a resonance frequency f of the vibrating plate satisfy a relationship of $0.8\times(k0c)/(2\pi) \leq af \geq 1.2\times(k0c)/(2\pi)$, where c is an acoustic velocity of gas passing through the first blower chamber and k0 is a value satisfying a relationship of a first kind Bessel function $J0(k0)=0$.

2. The blower according to claim 1, wherein the first vent hole in the housing is provided with a first valve preventing the gas from flowing into the first blower chamber from the outside of the first blower chamber.

3. The blower according to claim 1, wherein each point on the vibrating plate from the central axis of the first blower chamber to the outer periphery of the first blower chamber is displaced by a vibration, wherein, from the central axis of the first blower chamber to the outer periphery of the first blower chamber, a pressure at each point at the first blower chamber changes due to the vibration of the vibrating plate, and wherein, in a range from the central axis of the first blower chamber to the outer periphery of the first blower chamber, a number of points that the vibration displacement of the vibrating plate crosses zero is equal to a number of points that the pressure change in the blower chamber crosses zero.

4. The blower according to claim 1, wherein the vibrating plate includes a vibrating portion, a frame portion, and a plurality of connecting portions, the vibrating portion defining, together with the housing, the first blower chamber such that the first blower chamber is interposed therebetween in the thickness direction of the vibrating plate, the frame portion surrounding the vibrating portion and being joined to the housing, the connecting portions connecting the vibrating portion and the frame portion to each other and elastically supporting the vibrating portion with respect to the frame portion.

5. The blower according to claim 4, wherein the opening portion is located in a region of the vibrating plate positioned between the frame portion and an outermost node among nodes of the vibration of the vibrating plate.

6. The blower according to claim 4, wherein the opening portion is located in a region of the housing opposing to a region of the vibrating plate positioned between the frame portion and an outermost node among nodes of the vibration of the vibrating plate.

7. The blower according to claim 1, wherein the driving member is a piezoelectric member.

8. The blower according to claim 1, wherein the housing includes a first movable portion opposing to the second principal surface of the vibrating plate and undergoing a bending vibration in accordance with the concentric bending vibration of the vibrating plate.

9. The blower according to claim 1, wherein the housing defines, together with the actuator, a second blower chamber such that the second blower chamber is interposed therebetween in the thickness direction of the vibrating plate, the housing including a second vent hole allowing the second blower chamber to communicate with an outside of the second blower chamber, wherein the vibrating plate includes the opening portion allowing the outer periphery of the first blower chamber to communicate with an outer periphery of the second blower chamber, and wherein a shortest distance from a central axis of the second blower chamber to the outer periphery of the second blower chamber is equal to the shortest distance a.

10. The blower according to claim 9, wherein the second vent hole in the housing is provided with a second valve preventing the gas from flowing into the second blower chamber from the outside of the second blower chamber.

11. The blower according to claim 9, wherein each point on the vibrating plate from the central axis of the second blower chamber to the outer periphery of the second blower chamber is displaced by a vibration, wherein, from the central axis of the second blower chamber to the outer periphery of the second blower chamber, a pressure at each point at the second blower chamber changes due to the vibration of the vibrating plate, and wherein, in a range from the central axis of the second blower chamber to the outer periphery of the second blower chamber, a number of zero crossover points of the vibration displacement of the vibrating plate is equal to a number of zero crossover points of the pressure change in the second blower chamber.

12. The blower according to claim 9, wherein the housing includes a third vent hole allowing the outer periphery of at least one of the first blower chamber and the second blower chamber to communicate with an outside of the housing.

13. The blower according to claim 9, wherein the housing includes a second movable portion opposing to the first principal surface of the vibrating plate and undergoing a bending vibration in accordance with the concentric bending vibration of the vibrating plate.

14. The blower according to claim 2, wherein each point on the vibrating plate from the central axis of the first blower chamber to the outer periphery of the first blower chamber is displaced by a vibration, wherein, from the central axis of the first blower chamber to the outer periphery of the first blower chamber, a pressure at each point at the first blower chamber changes due to the vibration of the vibrating plate, and wherein, in a range from the central axis of the first blower chamber to the outer periphery of the first blower chamber, a number of zero crossover points of the vibration displacement of the vibrating plate is equal to a number of zero crossover points of the pressure change in the blower chamber.

15. The blower according to claim 2, wherein the vibrating plate includes a vibrating portion, a frame portion, and a plurality of connecting portions, the vibrating portion defining, together with the housing, the first blower chamber such that the first blower chamber is interposed therebetween in the thickness direction of the vibrating plate, the frame portion surrounding the vibrating portion and being joined to the housing, the connecting portions connecting the vibrating portion and the frame portion to each other and elastically supporting the vibrating portion with respect to the frame portion.

16. The blower according to claim 3, wherein the vibrating plate includes a vibrating portion, a frame portion, and a plurality of connecting portions, the vibrating portion defining, together with the housing, the first blower chamber such that the first blower chamber is interposed therebetween in the thickness direction of the vibrating plate, the frame portion surrounding the vibrating portion and being joined to the housing, the connecting portions connecting the vibrating portion and the frame portion to each other and elastically supporting the vibrating portion with respect to the frame portion.

17. The blower according to claim 2, wherein the driving member is a piezoelectric member.

18. The blower according to claim 3, wherein the driving member is a piezoelectric member.

19. The blower according to claim 4, wherein the driving member is a piezoelectric member.

20. The blower according to claim 5, wherein the driving member is a piezoelectric member.

21. The blower according to claim 1, wherein each of the housing and the vibrating plate includes opening portions and a total area of the opening portions of the housing is larger than a total area of the opening portions of the vibrating plate.

* * * * *